US008109586B2

(12) United States Patent
Benjamin

(10) Patent No.: US 8,109,586 B2
(45) Date of Patent: Feb. 7, 2012

(54) FLUID EJECTION DEVICE

(75) Inventor: Trudy Benjamin, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 699 days.

(21) Appl. No.: 11/849,748

(22) Filed: Sep. 4, 2007

(65) Prior Publication Data

US 2009/0058896 A1 Mar. 5, 2009

(51) Int. Cl.
*B41J 29/38* (2006.01)
*B41J 2/05* (2006.01)

(52) U.S. Cl. ..... 347/9; 347/12; 347/57

(58) Field of Classification Search ..... 347/9, 12, 347/57

See application file for complete search history.

(56) References Cited

U.S. PATENT DOCUMENTS

| | | | |
|---|---|---|---|
| 5,400,059 | A | 3/1995 | Kwon |
| 5,548,319 | A | 8/1996 | Kwon |
| 5,675,365 | A | 10/1997 | Becerra et al. |
| 6,190,000 | B1 | 2/2001 | Krouss et al. |
| 6,318,828 | B1 | 11/2001 | Barbour et al. |
| 6,425,653 | B1 | 7/2002 | Bloomberg |
| 6,439,697 | B1 | 8/2002 | Axtell et al. |
| 6,478,396 | B1 | 11/2002 | Schloeman et al. |
| 6,481,817 | B1 | 11/2002 | Torgerson et al. |
| 6,540,333 | B2 | 4/2003 | Axtell et al. |
| 6,543,882 | B2 | 4/2003 | Axtell et al. |
| 6,659,581 | B2 | 12/2003 | Schloeman et al. |
| 6,698,857 | B2 | 3/2004 | Torgerson et al. |
| 6,726,300 | B2 | 4/2004 | Schloeman et al. |
| 6,932,460 | B2 | 8/2005 | Axtell et al. |
| 7,029,084 | B2 | 4/2006 | Schloeman et al. |
| 7,036,914 | B1 | 5/2006 | Axtell et al. |
| 7,090,338 | B2 | 8/2006 | Axtell et al. |
| 7,104,624 | B2 | 9/2006 | Schloeman et al. |
| 2002/0036781 | A1 * | 3/2002 | Hirayama ..... 358/1.4 |
| 2005/0230493 | A1 | 10/2005 | Benjamin et al. |
| 2005/0231540 | A1 | 10/2005 | Benjamin et al. |
| 2005/0231541 | A1 | 10/2005 | Benjamin |
| 2005/0231545 | A1 | 10/2005 | Benjamin et al. |
| 2005/0231562 | A1 | 10/2005 | Torgerson et al. |
| 2006/0114277 | A1 | 6/2006 | Corrigan |
| 2006/0125861 | A1 | 6/2006 | Silverbrook et al. |
| 2006/0125876 | A1 | 6/2006 | Walmsley et al. |
| 2006/0132521 | A1 | 6/2006 | Walmsley et al. |
| 2006/0181558 | A1 | 8/2006 | Walmsley et al. |
| 2006/0274112 | A1 | 12/2006 | Jackson Pulver et al. |
| 2007/0019016 | A1 | 1/2007 | Silverbrook et al. |
| 2007/0046711 | A1 | 3/2007 | Barkley |
| 2007/0097178 | A1 | 5/2007 | Benjamin et al. |

FOREIGN PATENT DOCUMENTS

| | | |
|---|---|---|
| JP | 2002-29055 | 1/2002 |

OTHER PUBLICATIONS

International Search Report for Application No. PCT/US2008/075032. Report issued Mar. 25, 2009.

* cited by examiner

*Primary Examiner* — Matthew Luu
*Assistant Examiner* — Jannelle M Lebron

(57) ABSTRACT

Embodiments of a fluid ejection device are disclosed.

22 Claims, 13 Drawing Sheets

600 602 616 604 618 606 622 608 624 610 612 626 614 628

| T1 | T2 | T3 | T4 | T5 | T1 | T2 |
|---|---|---|---|---|---|---|
| PRE SN | EVAL SN | PRE SO | EVAL SO | | PRE SN | EVAL SN |
| | | PRE ADD | | EVAL ADD | ADD VAL | ADD VAL |
| 620 CSYNC INIT | | 630 | | 632 | 634 | 636 |
| 638 NEED DIRR+DIRF VALID | | | | | | NEED DIRR+DIRF VALID |
| | | | Possible CSYNC DIR | Possible CSYNC DIR | | 640 |

642 644

Fig. 12

FLUID EJECTION DEVICE

BACKGROUND

An inkjet printing system, as one embodiment of a fluid ejection system, may include a printhead, an ink supply that provides liquid ink to the printhead, and an electronic controller that controls the printhead. The printhead, as one embodiment of a fluid ejection device, ejects ink drops through a plurality of orifices or nozzles.

Manufacturers continue increasing the number of drop generators per input pad via reducing the number of input pads and/or increasing the number of drop generators on a printhead die. A printhead with fewer input pads typically costs less than a printhead with more input pads. Also, a printhead with more drop generators typically prints with higher quality and/or printing speed.

BRIEF DESCRIPTION OF THE DRAWINGS

Embodiments are better understood with reference to the following drawings. The elements of the drawings are not necessarily to scale relative to each other. Like reference numerals designate corresponding similar parts.

FIG. 12 is a table illustrating the operation of one embodiment of an address generator.

DETAILED DESCRIPTION

In the following detailed description, reference is made to the accompanying drawings, which form a part hereof, and in which is shown by way of illustration specific embodiments in which the present disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Figure 1:
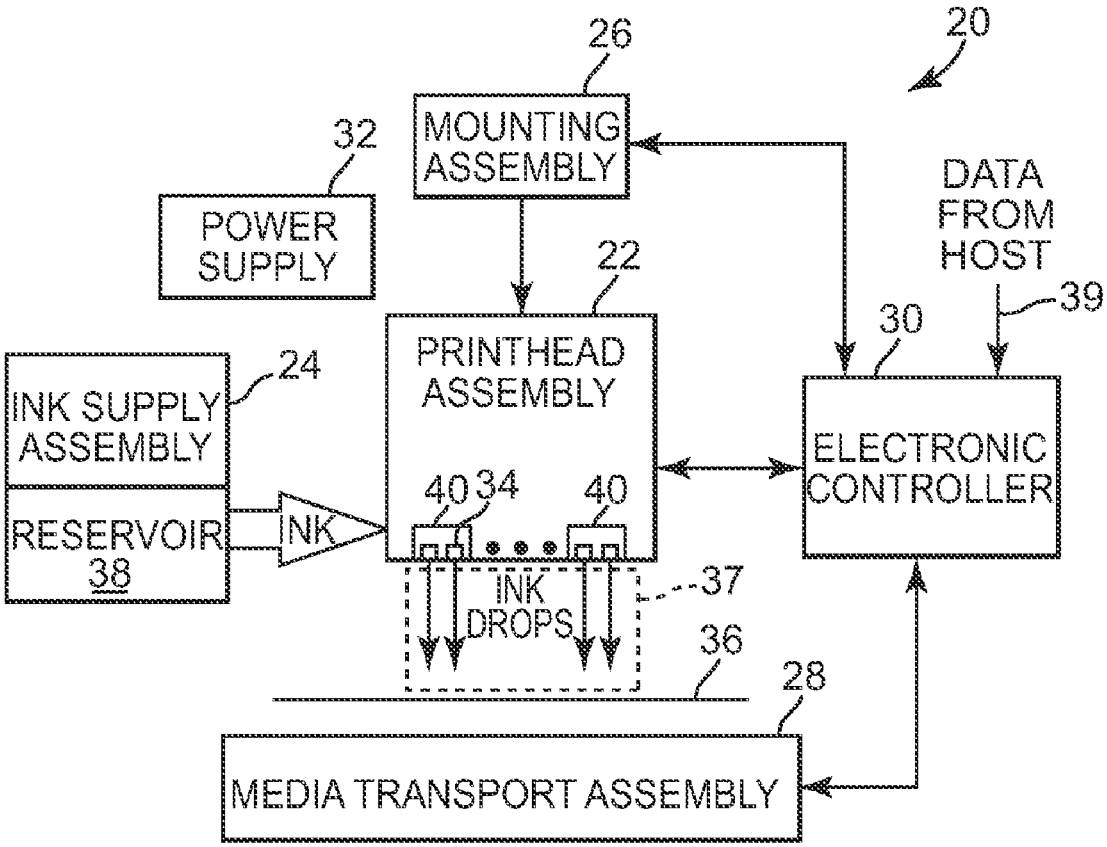
FIG. 1 illustrates one embodiment of an inkjet printing system.

FIG. 1 illustrates one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Ink supply assembly 24 as one embodiment of a fluid supply assembly provides ink to printhead assembly 22 and includes a reservoir 38 for storing ink. As such, ink flows from reservoir 38 to inkjet printhead assembly 22. Ink supply assembly 24 and inkjet printhead assembly 22 can form either a one-way ink delivery system or a recirculating ink delivery system. In a one-way ink delivery system, substantially all of the ink provided to inkjet printhead assembly 22 is consumed during printing. In a recirculating ink delivery system, only a portion of the ink provided to printhead assembly 22 is consumed during printing. As such, ink not consumed during printing is returned to ink supply assembly 24.

In one embodiment, inkjet printhead assembly 22 and ink supply assembly 24 are housed together in an inkjet cartridge or pen. The inkjet cartridge or pen is one embodiment of a fluid ejection device. In another embodiment, ink supply assembly 24 is separate from inkjet printhead assembly 22 and provides ink to inkjet printhead assembly 22 through an interface connection, such as a supply tube (not shown). In either embodiment, reservoir 38 of ink supply assembly 24 may be removed, replaced, and/or refilled. In one embodiment, where inkjet printhead assembly 22 and ink supply assembly 24 are housed together in an inkjet cartridge, reservoir 38 includes a local reservoir located within the cartridge and may also include a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
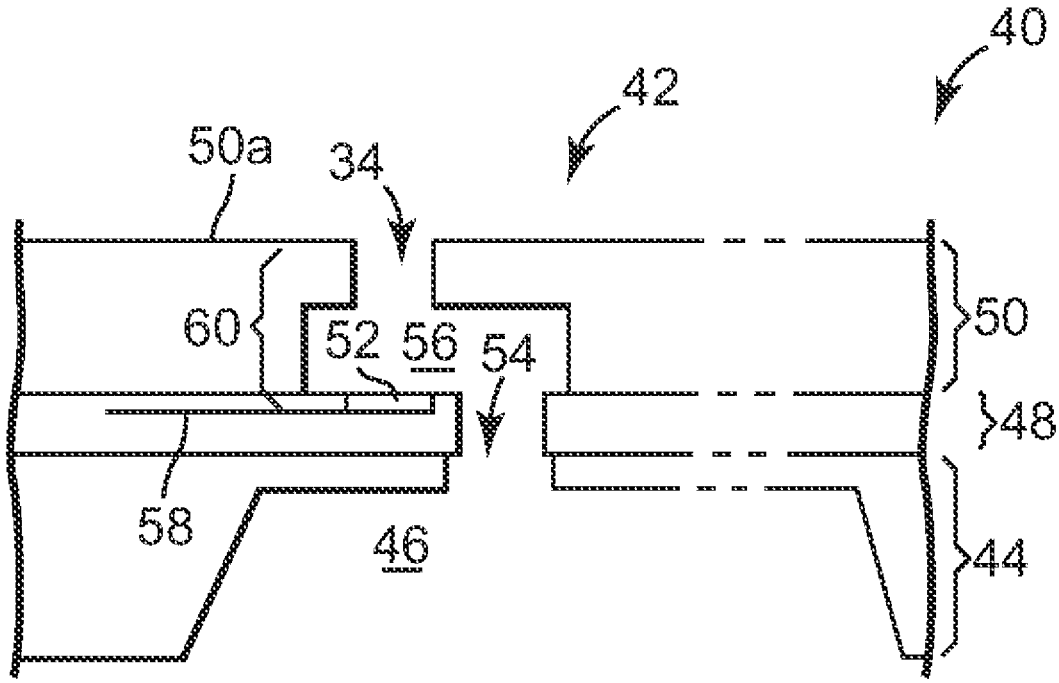
FIG. 2 is a diagram illustrating a portion of one embodiment of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energization of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48, also, includes at least one conductive layer, which defines firing resistor 52 and leads 58. The conductive layer is made, for example, to include aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48.

In one embodiment, orifice layer 50 comprises a photoimageable epoxy resin, for example, an epoxy referred to as SU8, marketed by Micro-Chem, Newton, Mass. Exemplary techniques for fabricating orifice layer 50 with SU8 or other polymers are described in detail in U.S. Pat. No. 6,162,589, which is herein incorporated by reference. In one embodiment, orifice layer 50 is formed of two separate layers referred to as a barrier layer (e.g., a dry film photo resist barrier layer) and a metal orifice layer (e.g., a nickel, copper, iron/nickel alloys, palladium, gold, or rhodium layer) formed over the barrier layer. Other suitable materials, however, can be employed to form orifice layer 50.

Figure 3:
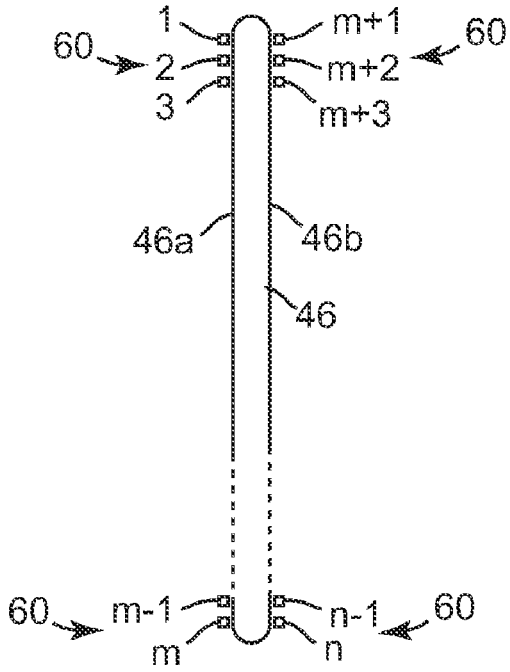
FIG. 3 is a diagram illustrating a layout of drop generators located along an ink feed slot in one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n-m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4:
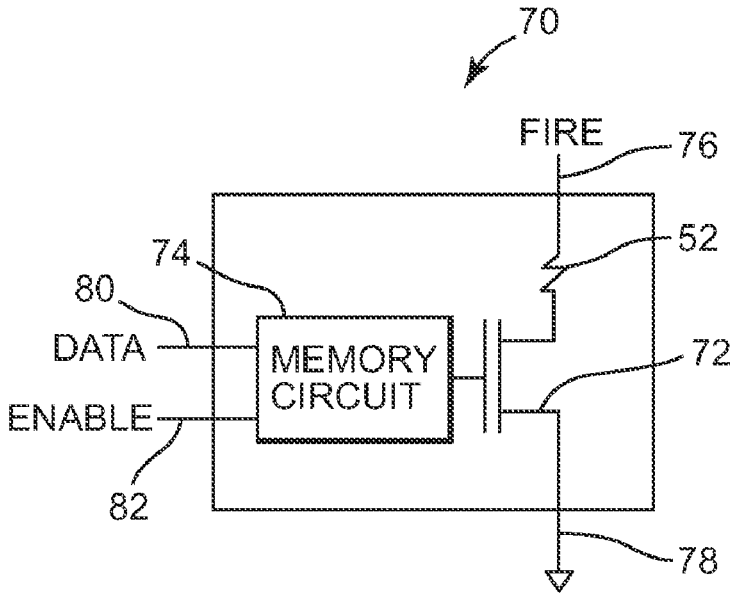
FIG. 4 is a diagram illustrating one embodiment of a firing cell employed in one embodiment of a printhead die.

FIG. 4 is a diagram illustrating one embodiment of a firing cell 70 employed in one embodiment of printhead die 40. Firing cell 70 includes a firing resistor 52, a resistor drive switch 72, and a memory circuit 74. Firing resistor 52 is part of a drop generator 60. Drive switch 72 and memory circuit 74 are part of the circuitry that controls the application of electrical current through firing resistor 52. Firing cell 70 is formed in thin-film structure 48 and on substrate 44.

In one embodiment, firing resistor 52 is a thin-film resistor and drive switch 72 is a field effect transistor (FET). Firing resistor 52 is electrically coupled to a fire line 76 and the drain-source path of drive switch 72. The drain-source path of drive switch 72 is also electrically coupled to a reference line 78 that is coupled to a reference voltage, such as ground. The gate of drive switch 72 is electrically coupled to memory circuit 74 that controls the state of drive switch 72.

Memory circuit 74 is electrically coupled to a data line 80 and the enable lines 82. Data line 80 receives a data signal DATA that represents part of an image and enable lines 82 receive enable signals ENABLE to control operation of memory circuit 74. Memory circuit 74 stores one bit of data as it is enabled by the enable signals ENABLE. The logic level of the stored data bit sets the state (e.g., on or off, conducting or non-conducting) of drive switch 72. The enable signals ENABLE can include one or more select signals and one or more address signals.

Fire line 76 receives an energy signal FIRE comprising energy pulses and provides an energy pulse to firing resistor 52. In one embodiment, the energy pulses are provided by electronic controller 30 to have timed starting times and timed duration, resulting in timed end times, to provide a proper amount of energy to heat and vaporize fluid in the vaporization chamber 56 of a drop generator 60. If drive switch 72 is on (conducting), the energy pulse heats firing resistor 52 to heat and eject fluid from drop generator 60. If drive switch 72 is off (non-conducting), the energy pulse does not heat firing resistor 52 and the fluid remains in drop generator 60.

Figure 5:
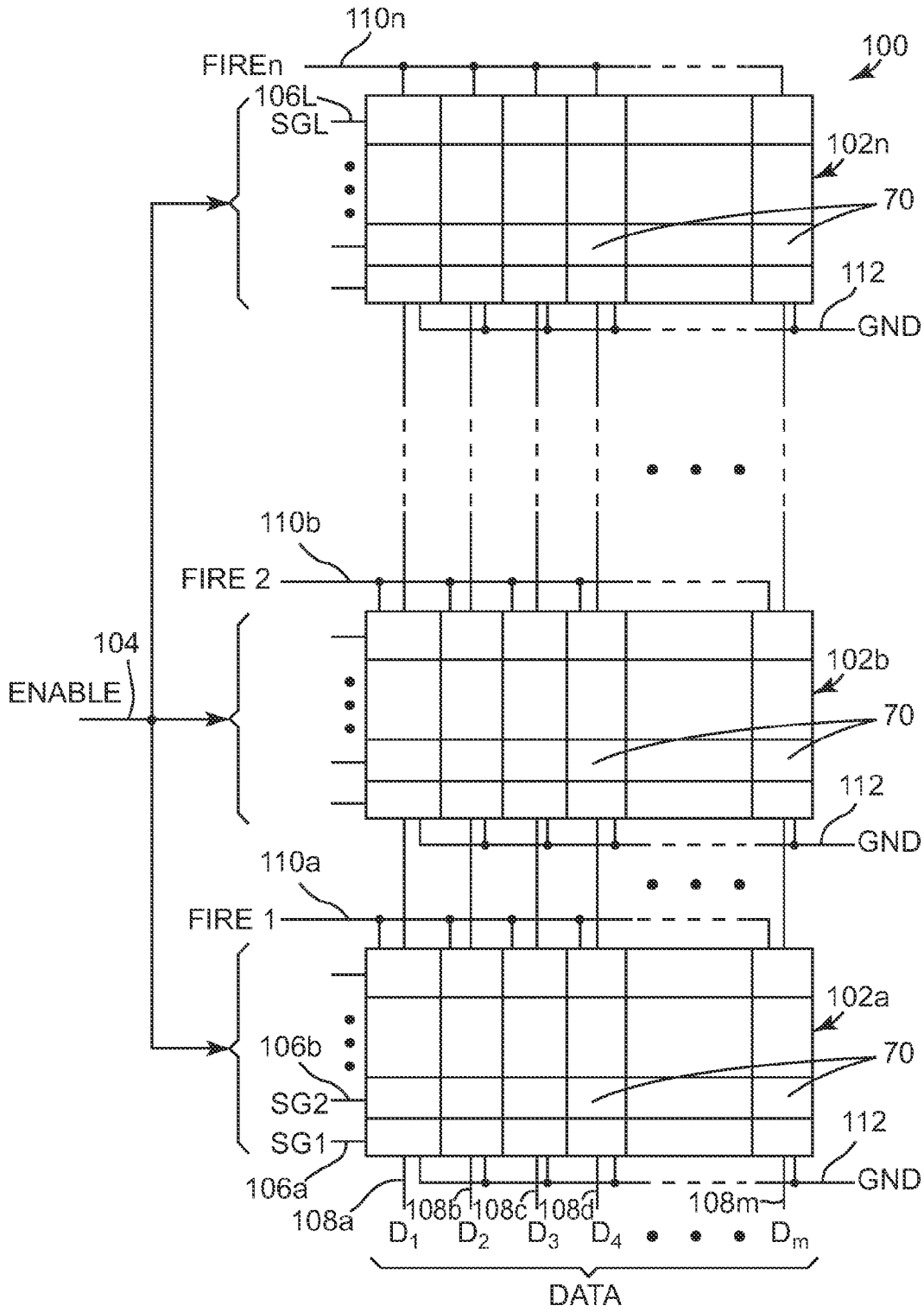
FIG. 5 is a schematic diagram illustrating one embodiment of an inkjet printhead firing cell array.

FIG. 5 is a schematic diagram illustrating one embodiment of an inkjet printhead firing cell array 100. Firing cell array 100 includes a plurality of firing cells 70 arranged into n fire groups 102*a*-102*n*. In one embodiment, firing cells 70 are arranged into four fire groups 102*a*-102*n*. In one embodiment, firing cells 70 are arranged into six fire groups 102*a*-102*n*. In other embodiments, firing cells 70 can be arranged into any suitable number of fire groups 102*a*-102*n*, such as four or more fire groups 102*a*-102*n*.

The firing cells 70 in array 100 are schematically arranged into L rows and m columns. The L rows of firing cells 70 are electrically coupled to enable lines 104 that receive enable signals ENABLE. Each row of firing cells 70, referred to herein as a row subgroup or subgroup of firing cells 70, is electrically coupled to one set of subgroup enable lines 106*a*-106L. The subgroup enable lines 106*a*-106L receive subgroup enable signals SG1, SG2, . . . $SG_L$ that enable the corresponding subgroup of firing cells 70.

Each column of firing cells 70, referred to herein as a data line group or data group, is electrically coupled to one of m data lines 108*a*-108*m* that receive data signals D1, D2 . . . Dm, respectively. Also, each of the m columns includes firing cells 70 in each of the n fire groups 102*a*-102*n*. In other words, each of the data lines 108*a*-108*m* is electrically coupled to each of the firing cells 70 in one column, including firing cells 70 in each of the fire groups 102*a*-102*n*. For example, data line 108*a* is electrically coupled to each of the firing cells 70 in the far left column, including firing cells 70 in each of the fire groups 102*a*-102*n*.

In one embodiment, array 100 is arranged into four fire groups 102*a*-102*n* and each of the four fire groups 102*a*-102*n* includes 13 subgroups and eight data line groups. In other embodiments, array 100 can be arranged into any suitable number of fire groups 102*a*-102*n* and into any suitable number of subgroups and data line groups. In any embodiment, fire groups 102*a*-102*n* are not limited to having the same number of subgroups and data line groups. Instead, each of the fire groups 102*a*-102*n* can have a different number of subgroups and/or data line groups as compared to any other fire group 102*a*-102*n*. In addition, each subgroup can have a different number of firing cells 70 as compared to any other subgroup, and each data line group can have a different number of firing cells 70 as compared to any other data line group.

Each of the firing cells 70 in each of the fire groups 102*a*-102*n* is electrically coupled to a corresponding one of the fire lines 110*a*-110*n*. For example, each of the firing cells 70 in fire group 102*a* is electrically coupled to fire line 110*a* that receives fire signal or energy signal FIRE1. In addition, each of the firing cells 70 in each of the fire groups 102*a*-102*n* is electrically coupled to a common reference line 112 that is tied to a reference, such as ground.

In operation, subgroup enable signals SG1, SG2, . . . $SG_L$ are provided on subgroup enable lines 106*a*-106L to enable one subgroup of firing cells 70. The enabled firing cells 70 store data signals D1, D2 . . . Dm provided on data lines 108*a*-108*m*. The data signals D1, D2 . . . Dm are stored in memory circuits 74 of enabled firing cells 70. Each of the stored data signals D1, D2 . . . Dm sets the state of drive switch 72 in one of the enabled firing cells 70. The drive switch 72 is set to conduct or not conduct based on the stored data signal value.

After the states of the selected drive switches 72 are set, an energy signal FIRE1-FIREn is provided on the fire line 110*a*-110*n* corresponding to the fire group 102*a*-102*n* that includes the selected subgroup of firing cells 70. The energy signal FIRE1-FIREn includes an energy pulse. The energy pulse is provided on the selected fire line 110*a*-110*n* to energize firing resistors 52 in firing cells 70 that have conducting drive switches 72. The energized firing resistors 52 heat and eject ink onto print medium 36 to print an image represented by data signals D1, D2 . . . Dm. The process of enabling a subgroup of firing cells 70, storing data signals D1, D2 . . . Dm in the enabled subgroup and providing an energy signal FIRE1-FIREn to energize firing resistors 52 in the enabled subgroup continues until printing stops.

In one embodiment, as an energy signal FIRE1-FIREn is provided to a selected fire group 102*a*-102*n*, subgroup enable signals SG1, SG2, . . . $SG_L$ change to select and enable another subgroup in a different fire group 102*a*-102*n*. The newly enabled subgroup stores data signals D1, D2 . . . Dm provided on data lines 108*a*-108*m* and an energy signal FIRE1-FIREn is provided on one of the fire lines 110*a*-110*n* to energize firing resistors 52 in the newly enabled firing cells 70. At any one time, only one subgroup of firing cells 70 is enabled by subgroup enable signals SG1, SG2, . . . SGL to store data signals D1, D2 . . . Dm provided on data lines 108*a*-108*m*. In this aspect, data signals D1, D2 Dm on data lines 108*a*-108*m* are timed division multiplexed data signals. Also, only one subgroup in a selected fire group 102*a*-102*n* includes drive switches 72 that are set to conduct while an energy signal FIRE1-FIREn is provided to the selected fire group 102*a*-102*n*. However, energy signals FIRE1-FIREn provided to different fire groups 102*a*-102*n* can and do overlap.

Figure 6:
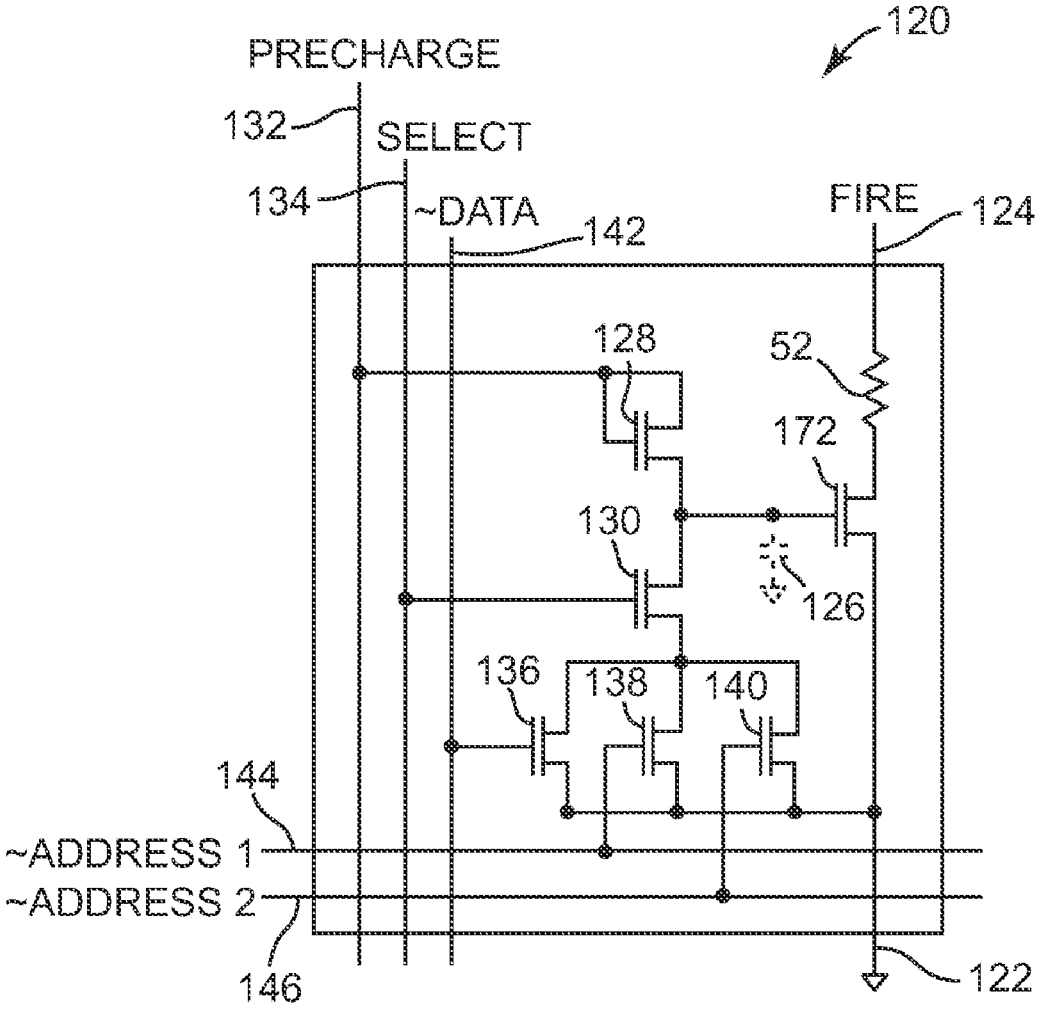
FIG. 6 is a schematic diagram illustrating one embodiment of a pre-charged firing cell.

FIG. 6 is a schematic diagram illustrating one embodiment of a pre-charged firing cell 120 that includes a drive switch 172 electrically coupled to firing resistor 52. Drive switch 172 is a FET including a drain-source path electrically coupled at one end to one terminal of firing resistor 52 and at the other end to a reference, such as ground, at 122. The other terminal of firing resistor 52 is electrically coupled to fire line 124 that receives an energy signal or fire signal FIRE. The energy signal FIRE includes energy pulses that energize firing resistor 52 if drive switch 172 is on (conducting).

The gate of drive switch 172 forms a storage node capacitance 126 that functions as a memory element to store data pursuant to the sequential activation of a pre-charge transistor 128 and a select transistor 130. The storage node capacitance 126 is shown in dashed lines, as it is part of drive switch 172. Alternatively, a capacitor separate from drive switch 172 can be used as a memory element.

The gate and drain-source path of pre-charge transistor 128 are electrically coupled to a pre-charge line 132 that receives a pre-charge signal PRECHARGE. The gate of drive switch 172 is electrically coupled to the drain-source path of pre-charge transistor 128 and the drain-source path of select transistor 130. The gate of select transistor 130 is electrically coupled to a select line 134 that receives a select signal SELECT. A pre-charge signal is one type of pulsed charge control signal. Another type of pulsed charge control signal is a discharge signal employed in embodiments of a discharged firing cell.

A data transistor 136, a first address transistor 138 and a second address transistor 140 include drain-source paths that are electrically coupled in parallel. The parallel combination of data transistor 136, first address transistor 138 and second address transistor 140 is electrically coupled between the drain-source path of select transistor 130 and reference 122. The serial circuit including select transistor 130 coupled to the parallel combination of data transistor 136, first address transistor 138 and second address transistor 140 is electrically coupled across node capacitance 126 of drive switch 172. The gate of data transistor 136 is electrically coupled to data line 142 that receives data signals DATA. The gate of first address transistor 138 is electrically coupled to an address line 144 that receives address signals ADDRESS1 and the gate of second address transistor 140 is electrically coupled to a second address line 146 that receives address signals ADDRESS2. The data signals DATA and address signals ADDRESS1 and ADDRESS2 are active when low as indicated by the tilda () at the beginning of the signal name. The node capacitance 126, pre-charge transistor 128, select transistor 130, data transistor 136 and address transistors 138 and 140 form a memory cell.

In operation, node capacitance 126 is pre-charged through pre-charge transistor 128 by providing a high level voltage pulse on pre-charge line 132. In one embodiment, after the high level voltage pulse on pre-charge line 132, a data signal DATA is provided on data line 142 to set the state of data transistor 136 and address signals ADDRESS1 and ADDRESS2 are provided on address lines 144 and 146 to set the states of first address transistor 138 and second address transistor 140. A high level voltage pulse is provided on select line 134 to turn on select transistor 130 and node capacitance 126 discharges if data transistor 136, first address transistor 138 and/or second address transistor 140 is on. Alternatively, node capacitance 126 remains charged if data transistor 136, first address transistor 138 and second address transistor 140 are all off.

Pre-charged firing cell 120 is an addressed firing cell if both address signals ADDRESS1 and ADDRESS2 are low and node capacitance 126 either discharges if data signal DATA is high or remains charged if data signal DATA is low. Pre-charged firing cell 120 is not an addressed firing cell if at least one of the address signals ADDRESS1 and ADDRESS2 is high and node capacitance 126 discharges regardless of the data signal DATA voltage level. The first and second address transistors 136 and 138 comprise an address decoder, and data transistor 136 controls the voltage level on node capacitance 126 if pre-charged firing cell 120 is addressed.

Figure 7:
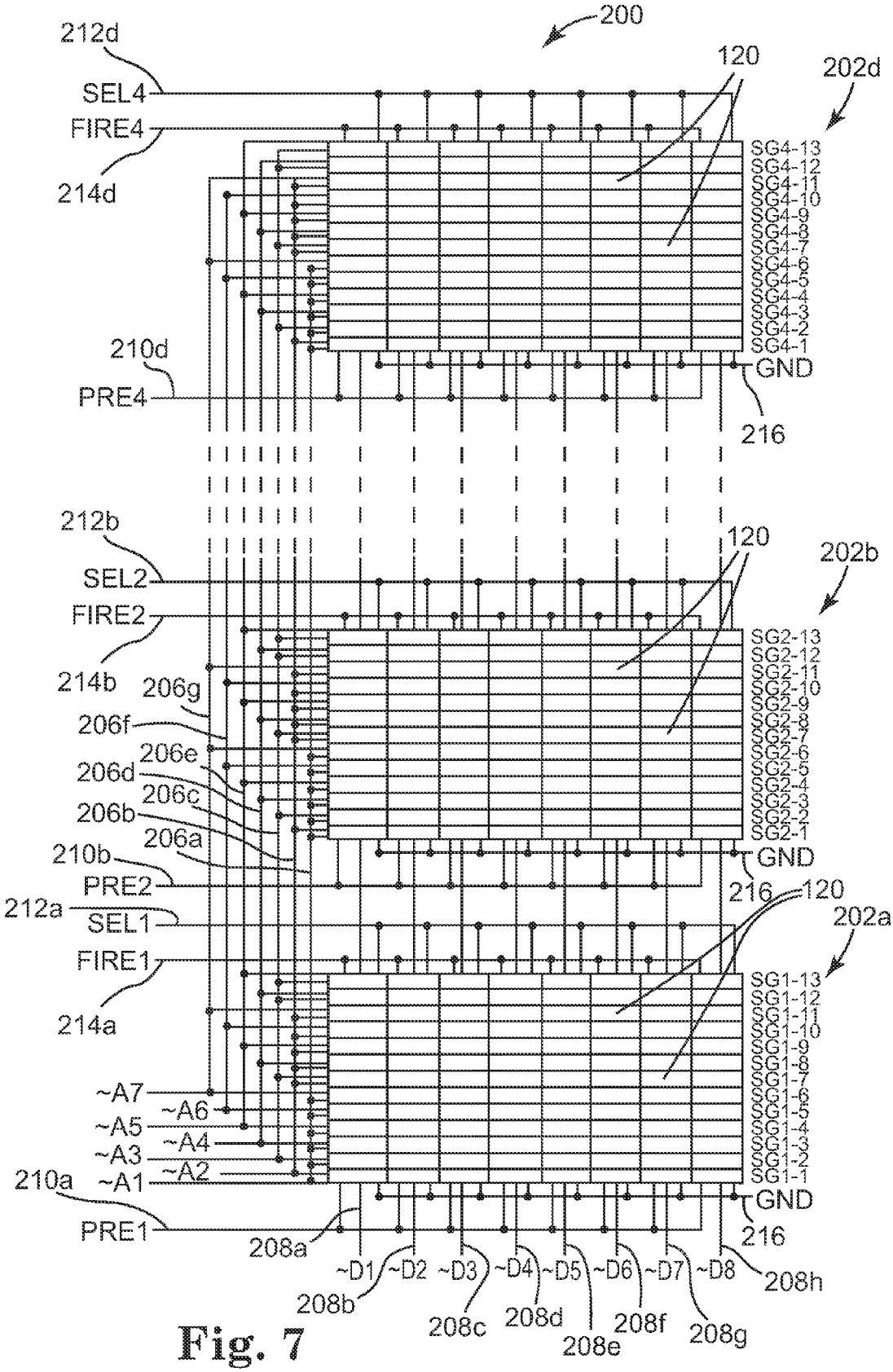
FIG. 7 is a schematic diagram illustrating one embodiment of an inkjet printhead firing cell array.

FIG. 7 is a schematic diagram illustrating one embodiment of an inkjet printhead firing cell array 200 that includes a plurality of pre-charged firing cells 120 arranged into four fire groups 202*a*-202*d*. The pre-charged firing cells 120 are schematically arranged into 52 rows and eight columns, where each fire group 202*a*-202*d* is schematically arranged into 13 rows and eight columns.

Each of the eight columns, referred to herein as a data line group or data group, includes pre-charged firing cells 120 in each of the four fire groups 202*a*-202*d*. Also, each of the pre-charged firing cells 120 in a data group is electrically coupled to a corresponding one of eight data lines 208*a*-208*h* that receive data signals D1, D2 . . . D8, respectively. For example, data line 208*a* is electrically coupled to each of the pre-charged firing cells 120 in the far left column, including pre-charged firing cells 120 in each of the four fire groups 202*a*-202*d*. All pre-charged firing cells 120 in a data group are electrically coupled to the same data line 208*a*-208*h* that is electrically coupled to the gate of the data transistor 136 in each of the pre-charged firing cells 120 of the data group. In one embodiment, each of the data signals D1, D2 . . . D8 represents a portion of an image. In one embodiment, each of the data lines 208*a*-208*h* is electrically coupled to external control circuitry via a corresponding interface data pad.

The 52 rows of pre-charged firing cells 120 are electrically coupled to address lines 206*a*-206*g* that receive address signals A1, A2 . . . A7, respectively. Each pre-charged firing cell 120 in a row of pre-charged firing cells 120, referred to herein as a row subgroup or subgroup of pre-charged firing cells 120, is electrically coupled to two of the address lines 206*a*-206*g*. All pre-charged firing cells 120 in a row subgroup are electrically coupled to the same two address lines 206*a*-206*g*.

The subgroups of the four fire groups 202*a*-202*d* are identified as subgroups SG1-1 through SG1-13 in fire group one (FG1) 202*a*, subgroups SG2-1 through SG2-13 in fire group two (FG2) 202*b* and so on, up to and including subgroups SG4-1 through SG4-13 in fire group four (FG4) 202*d*. In other embodiments, each fire group 202*a*-202*d* can include any suitable number of subgroups, such as a different number of subgroups than the other fire groups or 14 or more subgroups.

Each subgroup of pre-charged firing cells 120 is electrically coupled to two address lines 206*a*-206*g* that are electrically coupled to the first and second address transistors 138 and 140 in all pre-charged firing cells 120 of the subgroup. One address line is electrically coupled to the gate of one of the first and second address transistors 138 and 140 and the other address line is electrically coupled to the gate of the other one of the first and second address transistors 138 and 140. The address lines 206*a*-206*g* receive address signals A1, A2 . . . A7 and provide the address signals A1, A2 . . . A7 to the subgroups of array 200 as follows:

| Row Subgroup Address Signals | Row Subgroups |
|---|---|
| ~A1, ~A2 | SG1-1, SG2-1 . . . SG4-1 |
| ~A1, ~A3 | SG1-2, SG2-2 . . . SG4-2 |
| ~A1, ~A4 | SG1-3, SG2-3 . . . SG4-3 |
| ~A1, ~A5 | SG1-4, SG2-4 . . . SG4-4 |
| ~A1, ~A6 | SG1-5, SG2-5 . . . SG4-5 |
| ~A1, ~A7 | SG1-6, SG2-6 . . . SG4-6 |
| ~A2, ~A3 | SG1-7, SG2-7 . . . SG4-7 |
| ~A2, ~A4 | SG1-8, SG2-8 . . . SG4-8 |
| ~A2, ~A5 | SG1-9, SG2-9 . . . SG4-9 |
| ~A2, ~A6 | SG1-10, SG2-10 . . . SG4-10 |
| ~A2, ~A7 | SG1-11, SG2-11 . . . SG4-11 |
| ~A3, ~A4 | SG1-12, SG2-12 . . . SG4-12 |
| ~A3, ~A5 | SG1-13, SG2-13 . . . SG4-13 |

In other embodiments, address lines 206*a*-206*g* are electrically coupled to subgroups of array 200 in any suitable coupling of address lines 206*a*-206*g* to subgroups to provide any suitable mapping of row subgroup address signals to row subgroups.

Subgroups of pre-charged firing cells 120 are addressed by providing address signals A1, A2 . . . A7 on address lines 206*a*-206*g*. In one embodiment, the address lines 206*a*-206*g* are electrically coupled to one or more address generators provided on printhead die 40. In other embodiments, the address lines 206*a*-206*g* are electrically coupled to external control circuitry by interface pads.

Pre-charge lines 210*a*-210*d* receive pre-charge signals PRE1, PRE2 . . . PRE4, respectively, and each of the pre-charge lines 210*a*-210*d* is electrically coupled to all of the pre-charged firing cells 120 in one of the fire groups 202*a*-202*d*. Pre-charge line 210*a* is electrically coupled to all of the pre-charged firing cells 120 in FG1 202*a*, pre-charge line 210*b* is electrically coupled to all pre-charged firing cells 120 in FG2 202*b*, and so on, up to and including pre-charge line 210*d* that is electrically coupled to all pre-charged firing cells 120 in FG4 202*d*. Each of the pre-charge lines 210*a*-210*d* is electrically coupled to the gate and drain-source path of each of the pre-charge transistors 128 in the corresponding fire group 202*a*-202*d*, and all pre-charged firing cells 120 in a fire group 202*a*-202*d* are electrically coupled to only one pre-charge line 210*a*-210*d*. Thus, the node capacitances 126 of all pre-charged firing cells 120 in a fire group 202*a*-202*d* are charged via the one corresponding pre-charge signal PRE1, PRE2 . . . PRE4. In one embodiment, each of the pre-charge lines 210*a*-210*d* is electrically coupled to external control circuitry via a corresponding interface pad.

Select lines 212*a*-212*d* receive select signals SEL1, SEL2 . . . SEL4, respectively, and each of the select lines 212*a*-212*d* is electrically coupled to all of the pre-charged firing cells 120 in one of the fire groups 202*a*-202*d*. Select line 212*a* is electrically coupled to all pre-charged firing cells 120 in FG1 202*a*, select line 212*b* is electrically coupled to all pre-charged firing cells 120 in FG2 202*b*, and so on, up to and including select line 212*d* that is electrically coupled to all pre-charged firing cells 120 in FG4 202*d*. Each of the select lines 212*a*-212*d* is electrically coupled to the gate of each of the select transistors 130 in the corresponding fire group 202*a*-202*d*, and all pre-charged firing cells 120 in a fire group 202*a*-202*d* are electrically coupled to only one select line 212*a*-212*d*. In one embodiment, each of the select lines 212*a*-212*d* is electrically coupled to external control circuitry via a corresponding interface pad. Also, in one embodiment, some of the pre-charge lines 210*a*-210*d* and some of the select lines 212*a*-212*d* are electrically coupled together to share interface pads.

Fire lines 214*a*-214*d* receive fire signals or energy signals FIRE1, FIRE2 . . . FIRE4, respectively, and each of the fire lines 214*a*-214*d* is electrically coupled to all of the pre-charged firing cells 120 in one of the fire groups 202*a*-202*d*. Fire line 214*a* is electrically coupled to all pre-charged firing cells 120 in FG1 202*a*, fire line 214*b* is electrically coupled to all pre-charged firing cells 120 in FG2 202*b*, and so on, up to and including fire line 214*d* that is electrically coupled to all pre-charged firing cells 120 in FG4 202*d*. Each of the fire lines 214*a*-214*d* is electrically coupled to all of the firing resistors 52 in the corresponding fire group 202*a*-202*d*, and all pre-charged firing cells 120 in a fire group 202*a*-202*d* are electrically coupled to only one fire line 214*a*-214*d*. The fire lines 214*a*-214*d* are electrically coupled to external supply circuitry by appropriate interface pads. All pre-charged firing cells 120 in array 200 are electrically coupled to a reference line 216 that is tied to a reference voltage, such as ground.

Thus, the pre-charged firing cells 120 in a row subgroup of pre-charged firing cells 120 are electrically coupled to the same address lines 206*a*-206*g*, the same pre-charge line 210*a*-210*d*, the same select line 212*a*-212*d* and the same fire line 214*a*-214*d*.

In operation of one embodiment, fire groups 202*a*-202*d* are selected to fire in succession. FG1 202*a* is selected to fire before FG2 202*b*, which is selected to fire before fire group three (FG3), which is selected to fire before FG4 202*d*. After FG4 202*d*, the cycle starts over with FG1 202*a*.

The address signals A1, A2 . . . A7 are set to one row subgroup address during each cycle through the fire groups 202*a*-202*d*. Also, the address signals A1, A2 . . . A7 cycle through the 13 row subgroup addresses before repeating a row subgroup address. The address signals A1 A2 . . . A7 select a first row subgroup in each of the fire groups 202*a*-202*d* during a first cycle through the fire groups 202*a*-202*d*. For the next cycle through the fire groups 202*a*-202*d*, the address signals A1, A2 . . . A7 select the next row subgroup in each of the fire groups 202*a*-202*d*. This continues until the address signals A1, A2 . . . A7 have selected the last row subgroup in each of the fire groups 202*a*-202*d*. After the last row subgroup, the address signals A1, A2 . . . A7 can select the first row subgroup to begin the address cycle over again.

In another aspect of operation, one of the fire groups 202*a*-202*d* receives the corresponding one of the pre-charge signals PRE1, PRE2 . . . PRE4 that defines a pre-charge time interval or period. During the pre-charge time interval, the node capacitance 126 on each drive switch 172 in the one fire group 202*a*-202*d* is charged to a high voltage level to pre-charge the fire group 202*a*-202*d*.

Address signals A1, A2 . . . A7 are provided on address lines 206*a*-206*g* to address one row subgroup in each of the fire groups 202*a*-202*d*, including one row subgroup in the pre-charged fire group 202*a*-202*d*. Data signals D1, D2 . . . D8 are provided on data lines 208*a*-208*h* to provide data to all fire groups 202*a*-202*d*, including the addressed row subgroup in the pre-charged fire group 202*a*-202*d*.

Next, the corresponding one of the select signals SEL1, SEL2 . . . SEL4 is provided on the select line 212*a*-212*d* of the pre-charged fire group 202*a*-202*d* to select the pre-charged fire group 202*a*-202*d*. The select signal SEL1, SEL2 . . . SEL4 defines a discharge time interval for discharging the node capacitance 126 on each drive switch 172 in a pre-charged firing cell 120 that is either not in the addressed row subgroup in the selected fire group 202*a*-202*d* or addressed in the selected fire group 202*a*-202*d* and receiving a high level data signal D1, D2 . . . D8. The node capacitance 126 does not discharge in pre-charged firing cells 120 that are addressed in the selected fire group 202*a*-202*d* and receiving a low level data signal D1, D2 . . . D8. A high voltage level on the node capacitance 126 turns the drive switch 172 on (conducting).

After drive switches 172 in the selected fire group 202*a*-202*d* are set to conduct or not conduct, an energy pulse or voltage pulse is provided on the fire line 214*a*-214*d* of the selected fire group 202*a*-202*d*. Pre-charged firing cells 120 that have conducting drive switches 172, conduct current through the firing resistor 52 to heat ink and eject ink from the corresponding drop generator 60.

If fire groups 202*a*-202*d* are operated in succession, the select signal SEL1, SEL2 . . . SEL4 for one fire group 202*a*-202*d* is used as the pre-charge signal PRE1, PRE2 . . . PRE4 for the next fire group 202*a*-202*d*. This pre-charge signal PRE1, PRE2 . . . PRE4 precedes the select signal SEL1, SEL2 . . . SEL4 and the energy signal FIRE1, FIRE2 . . . FIRE4 for the fire group 202*a*-202*d*. After this pre-charge signal PRE1, PRE2 . . . PRE4, data signals D1, D2 . . . D8 are multiplexed in time and stored in the addressed row subgroup of the fire group 202*a*-202*d* via the select signal SEL1, SEL2 . . . SEL4 for the fire group 202a-202d. An energy pulse in the energy signal FIRE1, FIRE2 . . . FIRE4 for the fire group 202a-202d is provided to the selected fire group 202a-202d and pre-charged firing cells 120 in the selected row subgroup fire or heat ink based on the stored data signals D1, D2 . . . D8. The sequence continues for the next fire group 202a-202d, which has already been pre-charged via the select signal SEL1, SEL2 . . . SEL4 that just occurred.

Figure 8:
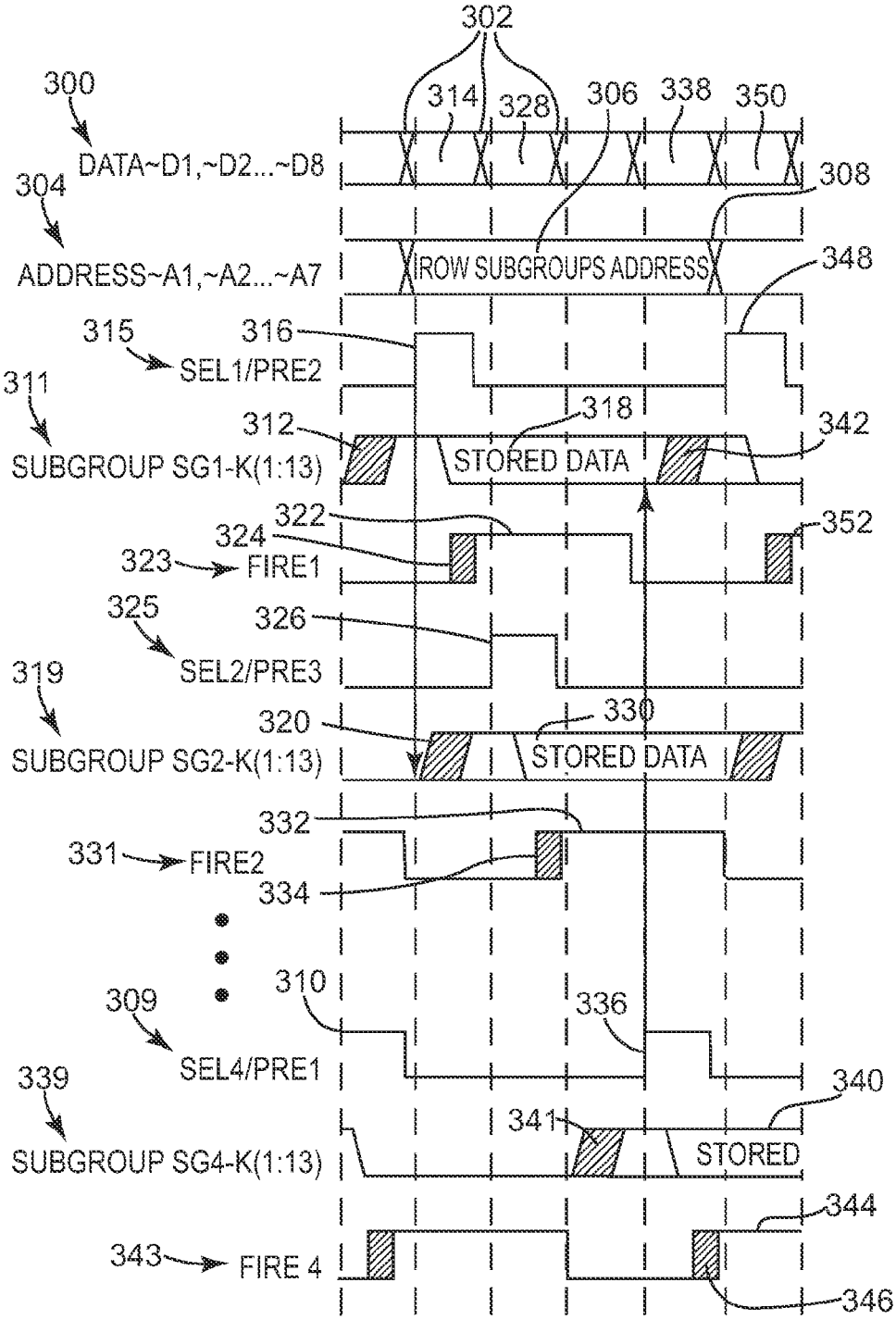
FIG. 8 is a timing diagram illustrating the operation of one embodiment of a firing cell array.

FIG. 8 is a timing diagram illustrating the operation of one embodiment of firing cell array 200. Fire groups 202a-202d are selected in succession to energize pre-charged firing cells 120 based on data signals D1, D2 . . . D8, indicated at 300. The data signals D1, D2 . . . D8 at 300 are changed as appropriate, indicated at 302, for each row subgroup address and fire group 202a-202d combination. Address signals A1, A2 . . . A7 at 304 are provided on address lines 206a-206g to address one row subgroup from each of the fire groups 202a-202d. The address signals A1, —A2 . . . —A7 at 304 are set to one address, indicated at 306, for one cycle through fire groups 202a-202d. After the cycle is complete, the address signals A1, A2 . . . —A7 at 304 are changed at 308 to address a different row subgroup from each of the fire groups 202a-202d. The address signals A1, —A2 . . . —A7 at 304 increment through the row subgroups to address the row subgroups in sequential order from one to 13 and back to one. In other embodiments, address signals —A1, —A2 . . . —A7 at 304 can be set to address row subgroups in any suitable order.

During a cycle through fire groups 202a-202d. select line 212d coupled to FG4 202d and pre-charge line 210a coupled to FG1 202a receive SEL4/PRE1 signal 309, including SEL4/PRE1 signal pulse 310. In one embodiment, the select line 212d and pre-charge line 210a are electrically coupled together to receive the same signal. In another embodiment, the select line 212d and pre-charge line 210a are not electrically coupled together, but receive similar signals.

The SEL4/PRE1 signal pulse at 310 on pre-charge line 210a, pre-charges all firing cells 120 in FG1 202a. The node capacitance 126 for each of the pre-charged firing cells 120 in FG1 202a is charged to a high voltage level. The node capacitances 126 for pre-charged firing cells 120 in one row subgroup SG1-K, indicated at 311, are pre-charged to a high voltage level at 312. The row subgroup address at 306 selects subgroup SG1-K, and a data signal set at 314 is provided to data transistors 136 in all pre-charged firing cells 120 of all fire groups 202a-202d, including the address selected row subgroup SG1-K.

The select line 212a for FG1 202a and pre-charge line 210b for FG2 202b receive the SEL1/PRE2 signal 315, including the SEL1/PRE2 signal pulse 316. The SEL1/PRE2 signal pulse 316 on select line 212a turns on the select transistor 130 in each of the pre-charged firing cells 120 in FG1 202a. The node capacitance 126 is discharged in all pre-charged firing cells 120 in FG1 202a that are not in the address selected row subgroup SG1-K. In the address selected row subgroup SG1-K, data at 314 are stored, indicated at 318, in the node capacitances 126 of the drive switches 172 in row subgroup SG1-K to either turn the drive switch on (conducting) or off (non-conducting).

The SEL1/PRE2 signal pulse at 316 on pre-charge line 210b, pre-charges all firing cells 120 in FG2 202b. The node capacitance 126 for each of the pre-charged firing cells 120 in FG2 202b is charged to a high voltage level. The node capacitances 126 for pre-charged firing cells 120 in one row subgroup SG2-K, indicated at 319, are pre-charged to a high voltage level at 320. The row subgroup address at 306 selects subgroup SG2-K, and a data signal set at 328 is provided to data transistors 136 in all pre-charged firing cells 120 of all fire groups 202a-202d, including the address selected row subgroup SG2-K.

The fire line 214a receives energy signal FIRE1, indicated at 323, including an energy pulse at 322 to energize firing resistors 52 in pre-charged firing cells 120 that have conductive drive switches 172 in FG1 202a. The FIRE1 energy pulse 322 goes high while the SEL1/PRE2 signal pulse 316 is high and while the node capacitance 126 on non-conducting drive switches 172 are being actively pulled low, indicated on energy signal FIRE1 323 at 324. Switching the energy pulse 322 high while the node capacitances 126 are actively pulled low, prevents the node capacitances 126 from being inadvertently charged through the drive switch 172 as the energy pulse 322 goes high. The SEL1/PRE2 signal 315 goes low and the energy pulse 322 is provided to FG1 202a for a predetermined time to heat ink and eject the ink through nozzles 34 corresponding to the conducting pre-charged firing cells 120.

The select line 212b for FG2 202b and pre-charge line 210c for FG3 202c receive SEL2/PRE3 signal 325, including SEL2/PRE3 signal pulse 326. After the SEL1/PRE2 signal pulse 316 goes low and while the energy pulse 322 is high, the SEL2/PRE3 signal pulse 326 on select line 212b turns on select transistor 130 in each of the pre-charged firing cells 120 in FG2 202b. The node capacitance 126 is discharged on all pre-charged firing cells 120 in FG2 202b that are not in the address selected row subgroup SG2-K. Data signal set 328 for subgroup SG2-K is stored in the pre-charged firing cells 120 of subgroup SG2-K, indicated at 330, to either turn the drive switches 172 on (conducting) or off (non-conducting). Also, the SEL2/PRE3 signal pulse on pre-charge line 210c pre-charges all pre-charged firing cells 120 in FG3 202c.

Fire line 214b receives energy signal FIRE2, indicated at 331, including energy pulse 332, to energize firing resistors 52 in pre-charged firing cells 120 of FG2 202b that have conducting drive switches 172. The FIRE2 energy pulse 332 goes high while the SEL2/PRE3 signal pulse 326 is high, indicated at 334. The SEL2/PRE3 signal pulse 326 goes low and the FIRE2 energy pulse 332 remains high to heat and eject ink from the corresponding drop generator 60.

After the SEL2/PRE3 signal pulse 326 goes low and while the energy pulse 332 is high, a SEL3/PRE4 signal is provided to select FG3 202c and pre-charge FG4 202d. The process of providing an energy signal including an energy pulse to FG3 202c continues.

The SEL3/PRE4 signal pulse on pre-charge line 210d, pre-charges all firing cells 120 in FG4 202d. The node capacitance 126 for each of the pre-charged firing cells 120 in FG4 202d is charged to a high voltage level. The node capacitances 126 for pre-charged firing cells 120 in one row subgroup SG4-K, indicated at 339, are pre-charged to a high voltage level at 341. The row subgroup address at 306 selects subgroup SG4-K, and data signal set 338 is provided to data transistors 136 in all pre-charged firing cells 120 of all fire groups 202a-202d, including the address selected row subgroup SG4-K.

The select line 212d for FG4 202d and pre-charge line 210a for FG1 202a receive a second SEL4/PRE1 signal pulse at 336. The second SEL4/PRE1 signal pulse 336 on select line 212d turns on the select transistor 130 in each of the pre-charged firing cells 120 in FG4 202d. The node capacitance 126 is discharged in all pre-charged firing cells 120 in FG4 202d that are not in the address selected row subgroup SG4-K. In the address selected row subgroup SG4-K, data 338 are stored at 340 in the node capacitances 126 of each drive switch 172 to either turn the drive switch on or off.

The SEL4/PRE1 signal on pre-charge line 210*a*, pre-charges node capacitances 126 in all firing cells 120 in FG1 202*a*, including firing cells 120 in row subgroup SG1-K, indicated at 342, to a high voltage level. The firing cells 120 in FG1 202*a* are pre-charged while the address signals A1, A2 . . . A7 304 select row subgroups SG1-K, SG2-K and so on, up to row subgroup SG4-K.

The fire line 214*d* receives energy signal FIRE4, indicated at 343, including an energy pulse at 344 to energize fire resistors 52 in pre-charged firing cells 120 that have conductive drive switches 172 in FG4 202*d*. The energy pulse 344 goes high while the SEL4/PRE1 signal pulse 336 is high and node capacitances 126 on non-conducting drive switches 172 are being actively pulled low, indicated at 346. Switching the energy pulse 344 high while the node capacitances 126 are actively pulled low, prevents the node capacitances 126 from being inadvertently charged through drive switch 172 as the energy pulse 344 goes high. The SEL4/PRE1 signal pulse 336 goes low and the energy pulse 344 is maintained high for a predetermined time to heat ink and eject ink through nozzles 34 corresponding to the conducting pre-charged firing cells 120.

After the SEL4/PRE1 signal pulse 336 goes low and while the energy pulse 344 is high, address signals A1, A2 . . . A7 304 are changed at 308 to select another set of subgroups SG1-K+1, SG2-K+1 and so on, up to SG4-K+1. The select line 212*a* for FG1 202*a* and pre-charge line 210*b* for FG2 202*b* receive a SEL1/PRE2 signal pulse, indicated at 348. The SEL1/PRE2 signal pulse 348 on select line 212*a* turns on the select transistor 130 in each of the pre-charged firing cells 120 in FG1 202*a*. The node capacitance 126 is discharged in all pre-charged firing cells 120 in FG1 202*a* that are not in the address selected subgroup SG1-K+1. Data signal set 350 for row subgroup SG1-K+1 is stored in the pre-charged firing cells 120 of subgroup SG1-K+1 to either turn drive switches 172 on or off. The SEL1/PRE2 signal pulse 348 on pre-charge line 210*b* pre-charges all firing cells 120 in FG2 202*b*.

The fire line 214*a* receives energy pulse 352 to energize firing resistors 52 and pre-charged firing cells 120 of FG1 202*a* that have conducting drive switches 172. The energy pulse 352 goes high while the SEL1/PRE2 signal pulse at 348 is high. The SEL1/PRE2 signal pulse 348 goes low and the energy pulse 352 remains high to heat and eject ink from corresponding drop generators 60. The process continues until printing is complete.

Figure 9:
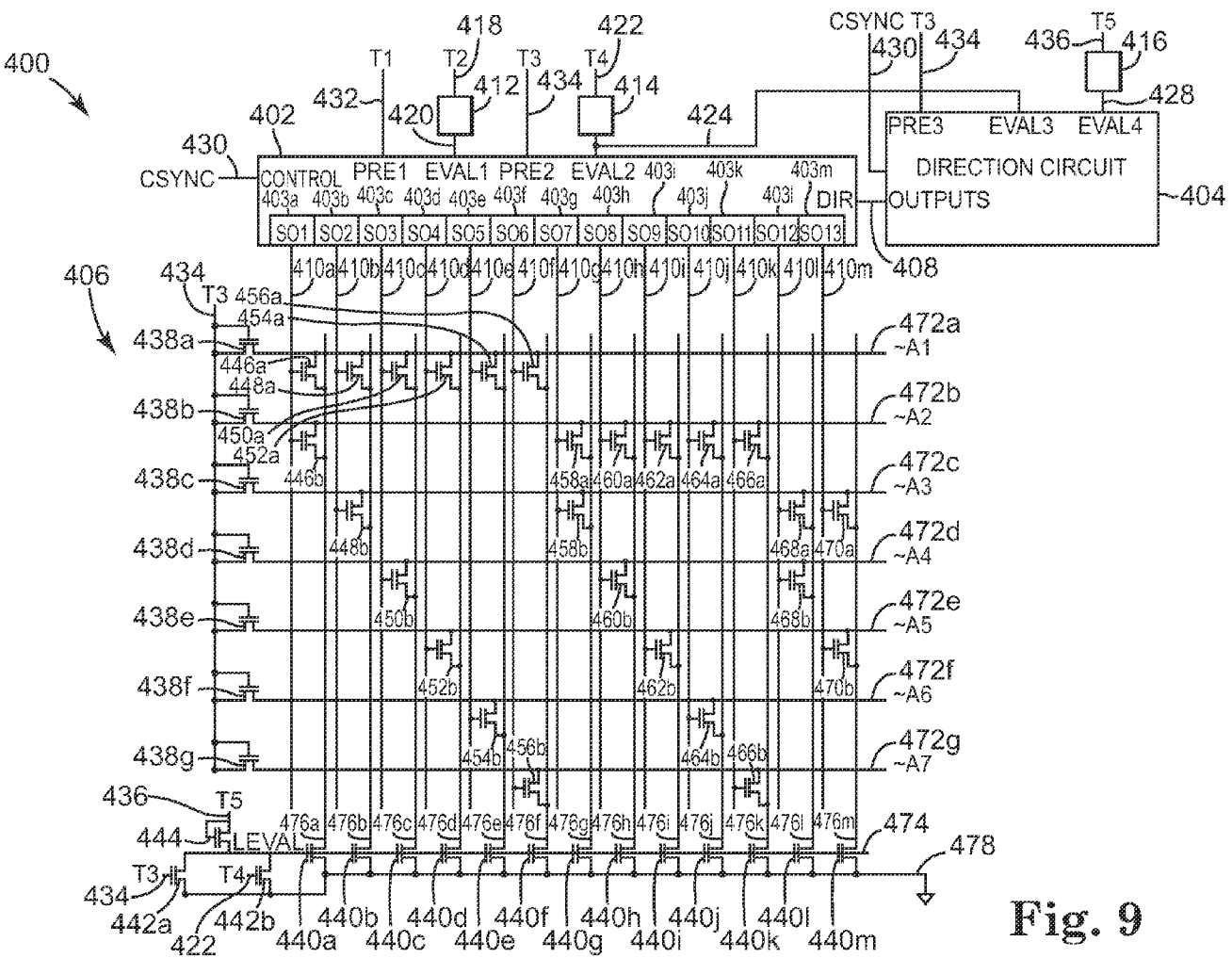
FIG. 9 is a diagram illustrating one embodiment of an address generator in a printhead die.

FIG. 9 is a diagram illustrating one embodiment of an address generator 400 in printhead die 40. The address generator 400 includes a shift register 402, a direction circuit 404 and a logic array 406. The shift register 402 is electrically coupled to direction circuit 404 through direction control lines 408. Also, shift register 402 is electrically coupled to logic array 406 through shift register output lines 410*a*-410*m*.

In the embodiments described below, the address generator 400 provides address signals to firing cells 120. In one embodiment, the address generator 400 receives external signals including a control signal CSYNC and five timing signals T1-T5 and in response provides seven address signals A1, A2, . . . A7, where the address signals A1, A2, . . . A7 are active low signals as indicated by the preceding tilda on each signal name. In one embodiment, the timing signals T1-T5 are provided on select lines, such as select lines 212*a*-212*d* (shown in FIG. 7).

The address generator 400 is one embodiment of a control circuit configured to respond to a control signal (e.g., CSYNC) to initiate a sequence (e.g., a sequence of addresses A1, A2 . . . A7 in forward or reverse order) to enable the firing cells 120 for activation.

Shift register 402 includes thirteen shift register cells 403*a*-403*m* that provide thirteen shift register output signals SO1-SO13. Each of the shift register cells 403*a*-403*m* provides one of the shift register output signals SO1-SO13, respectively. In addition, each of the shift register cells 403*a*-403*m* provides the corresponding one of the shift register output signals SO1-SO13 on one of the shift register output lines 410*a*-410*m*, respectively. The thirteen shift register cells 403*a*-403*m* are electrically coupled in series to provide shifting in the forward direction and the reverse direction. In other embodiments, shift register 402 can include any suitable number of shift register cells 403 to provide any suitable number of shift register output signals.

The address generator 400 includes resistor divide networks 412, 414 and 416 that receive timing signals T2, T4 and T5. Resistor divide network 412 receives timing signal T2 through timing signal line 418 and divides down the voltage level of timing signal T2 to provide a reduced voltage level T2 timing signal on first evaluation signal line 420. Resistor divide network 414 receives timing signal T4 though timing signal line 422 and divides down the voltage level of timing signal T4 to provide a reduced voltage level T4 timing signal on second evaluation signal line 424. Resistor divide network 416 receives timing signal T5 through timing signal line 436 and divides down the voltage level of timing signal T5 to provide a reduced voltage level T5 timing signal on fourth evaluation signal line 428.

The shift register 402 receives control signal CSYNC through control signal line 430 and direction signals through direction signal lines 408. Also, shift register 402 receives timing signal TI through timing signal line 432 as first pre-charge signal PRE1. The reduced voltage level T2 timing signal is received through first evaluation signal line 420 as first evaluation signal EVAL1. Timing signal T3 is received through timing signal line 434 as second pre-charge signal PRE2, and the reduced voltage level T4 timing signal is received through second evaluation signal line 424 as second evaluation signal EVAL2.

The direction circuit 404 provides direction signals to shift register 402 through direction signal lines 408. The direction circuit 404 receives control signal CSYNC on control signal line 430, timing signal T3 on timing signal line 434 as third pre-charge signal PRE3, the reduced voltage level T4 timing signal on evaluation signal line 424 as third evaluation signal EVAL3, and the reduced voltage level T5 timing signal on fourth evaluation signal line 428 as fourth evaluation signal EVAL4. In another embodiment, the direction circuit 404 receives control signal CSYNC on control signal line 430, timing signal T3 on timing signal line 434 as third pre-charge signal PRE3, the reduced voltage level T5 timing signal, instead of the reduced voltage level T4 timing signal, as third evaluation signal EVAL3, and a reduced voltage level T1 timing signal, instead of the reduced voltage level T5 timing signal, as fourth evaluation signal EVAL4.

The logic array 406 includes address line pre-charge transistors 438*a*-438*g*, address evaluation transistors 440*a*-440*m*, evaluation prevention transistors 442*a* and 442*b*, and logic evaluation pre-charge transistor 444. Logic array 406 also includes address transistors 446, 448, . . . 470 that decode shift register output signals SO1-SO13 on shift register output lines 410*a*-410*m* to provide address signals A1, A2, . . . A7. The address transistors 446, 448, . . . 470 include address one transistors 446*a* and 446*b* through address thirteen transistors 470*a* and 470*b*.

The address line pre-charge transistors 438*a*-438*g* are electrically coupled to T3 signal line 434 and address lines 472*a*-472*g*. The gate and one side of the drain-source path of each of the address line pre-charge transistors 438*a*-438*g* are electrically coupled to T3 signal line 434. The other side of the drain-source path of each of the address line pre-charge transistors 438*a*-438*g* is electrically coupled to a corresponding one of the address lines 472*a*-472*g*, respectively. In one embodiment, address line pre-charge transistors 438*a*-438*g* are electrically coupled to T4 signal line 422, instead of T3 signal line 434, where the T4 signal line 422 is electrically coupled to the gate and one side of the drain-source path of each of the address line pre-charge transistor 438*a*-438*g*.

The gate of each of the address evaluation transistors 440*a*-440*m* is electrically coupled to logic evaluation signal line 474. Also, one side of the drain-source path of each of the address evaluation transistors 440*a*-440*m* is electrically coupled to one of the evaluation lines 476*a*-476*m*, respectively, and the other side of the drain-source path of each of the address evaluation transistors 440*a*-440*m* is electrically coupled to ground. The gate and one side of the drain-source path of logic evaluation pre-charge transistor 444 are electrically coupled to T5 signal line 436 and the other side of the drain-source path is electrically coupled to logic evaluation signal line 474.

The gate of evaluation prevention transistor 442*a* is electrically coupled to T3 signal line 434 and the gate of evaluation prevention transistor 442*b* is electrically coupled to T4 signal line 422. The drain-source path of each of the evaluation prevention transistors 442*a* and 442*b* is electrically coupled on one side to logic evaluation signal line 474 and on the other side to the reference at 478.

The gates of address transistors 446, 448, . . . 470 are driven by the shift register output signals SO1-SO13 via the shift register output signal lines 410*a*-410*m*, respectively. The drain-source paths of address transistors 446, 448, . . . 470 are electrically coupled between address lines 472*a*-472*g* and evaluation lines 476*a*-476*m* as follows:

| Address Transistors | Coupled Between Lines |
|---|---|
| 446a and 446b | 472a-476a and 472b-476a |
| 448a and 448b | 472a-476b and 472c-476b |
| 450a and 450b | 472a-476c and 472d-476c |
| 452a and 452b | 472a-476d and 472e-476d |
| 454a and 454b | 472a-476e and 472f-476e |
| 456a and 456b | 472a-476f and 472g-476f |
| 458a and 458b | 472b-476g and 472c-476g |
| 460a and 460b | 472b-476h and 472d-476h |
| 462a and 462b | 472b-476i and 472e-476i |
| 464a and 464b | 472b-476j and 472f-476j |
| 466a and 466b | 472b-476k and 472g-476k |
| 468a and 468b | 472c-476l and 472d-476l |
| 470a and 470b | 472c-476m and 472e-476m |

For example, the drain-source path of address transistor 446*a* is electrically coupled between address line 472*a* and evaluation line 476*a*, and the drain-source path of address transistor 446*b* is electrically coupled between address line 472*b* and evaluation line 476*a*.

A high level shift register output signal SO1-SO13 on one of the shift register output signal lines 410*a*-410*m* turns on the corresponding address transistors 446, 448, . . . 470. The conducting address transistors 446, 448, . . . 470 actively pull the corresponding address lines 472*a*-472*g* to a low voltage level, if the address evaluation transistors 440*a*-440*m* are turned on via a high voltage level evaluation signal LEVAL on logic evaluation signal line 474.

For example, the gates of address one transistors 446*a* and 446*b* are electrically coupled to shift register output signal line 410*a*. A high level shift register output signal SO1 on shift register output signal line 410*a* turns on address one transistors 446*a* and 446*b*. Address evaluation transistor 440*a* is turned on by a high voltage level evaluation signal LEVAL on logic evaluation signal line 474. The address one transistor 446*a* and address evaluation transistor 440*a* conduct to actively pull address line 472*a* to a low voltage level, and the address one transistor 446*b* and address evaluation transistor 440*a* conduct to actively pull address line 472*b* to a low voltage level.

The shift register 402 shifts a single high voltage level output signal from one shift register output signal line 410*a*-410*m* to the next shift register output signal line 410*a*-410*m*. The shift register 402 shifts the single high voltage level output signal in a forward direction from shift register output signal SO1 or in a reverse direction from shift register output signal S13 based on the direction signals at 408.

Shift register 402 receives a control pulse in control signal CSYNC on control line 430 and a series of timing pulses from timing signals T1-T4 to shift the received control pulse into shift register 402. In response, shift register 402 provides a single high voltage level shift register output signal SO1 or SO13. All of the other shift register output signals SO1-SO13 are provided at low voltage levels. Shift register 402 receives another series of timing pulses from timing signals T1-T4 and shifts the single high voltage level output signal from one shift register output signal SO1-SO13 to the next shift register output signal SO1-SO13, with all other shift register output signals SO1-SO13 provided at low voltage levels. Shift register 402 receives a repeating series of timing pulses and in response to each series of timing pulses, shift register 402 shifts the single high voltage level output signal to provide a series of up to thirteen high voltage level shift register output signals SO1-SO13. Each high voltage level shift register output signal SO1-SO13 turns on two address transistors 446, 448, . . . 470 to provide address signals A1, A2, . . . A7 to firing cells 120. The address signals A1, A2, . . . A7 are provided in thirteen address time slots that correspond to the thirteen shift register output signals SO1-SO13. In another embodiment, shift register 402 can include any suitable number of shift register output signals, such as fourteen, to provide address signals A1, A2, . . . A7 in any suitable number of address time slots, such as fourteen address time slots.

The shift register 402 receives direction signals from direction circuit 404 through direction signal lines 408. The direction signals set up the direction of shifting in shift register 402. The shift register 402 can be set to shift the high voltage level output signal in a forward direction, from shift register output signal SO1 to shift register output signal SO13, or in a reverse direction, from shift register output signal SO13 to shift register output signal SO1.

In the forward direction, shift register 402 receives the control pulse in control signal CSYNC and provides a high voltage level shift register output signal SO1. All other shift register output signals SO2-SO13 are provided at low voltage levels. Shift register 402 receives the next series of timing pulses and provides a high voltage level shift register output signal SO2, with all other shift register output signals SO1 and SO3-SO13 provided at low voltage levels. Shift register 402 receives the next series of timing pulses and provides a high voltage level shift register output signal SO3, with all other shift register output signals SO1, SO2, and SO4-SO13 provided at low voltage levels. Shift register 402 continues to shift the high level output signal in response to each series of timing pulses up to and including providing a high voltage level shift register output signal SO13, with all other shift register output signals SO1-SO12 provided at low voltage levels. After providing the high voltage level shift register output signal SO13, shift register 402 receives the next series of timing pulses and provides low voltage level signals for all shift register output signals SO1-SO13. Another control pulse in control signal CSYNC is provided to start or initiate shift register 402 shifting in the forward direction series of high voltage level output signals from shift register output signal SO1 to shift register output signal SO13.

In the reverse direction, shift register 402 receives a control pulse in control signal CSYNC and provides a high level shift register output signal SO13. All other shift register output signals SO1-SO12 are provided at low voltage levels. Shift register 402 receives the next series of timing pulses and provides a high voltage level shift register output signal SO12, with all other shift register output signals SO1-SO11 and SO13 provided at low voltage levels. Shift register 402 receives the next series of timing pulses and provides a high voltage level shift register output signal SO11, with all other shift register output signals SO1-SO10, SO12 and SO13 provided at low voltage levels. Shift register 402 continues to shift the high voltage level output signal in response to each series of timing pulses, up to and including providing a high voltage level shift register output signal SO1, with all other shift register output signals SO2-SO13 provided at low voltage levels. After providing the high voltage level shift register output signal SO1, shift register 402 receives the next series of timing pulses and provides low voltage level signals for all shift register output signals SO1-SO13. Another control pulse in control signal CSYNC is provided to start or initiate shift register 402 shifting in the reverse direction series of high voltage output signals from shift register output signal SO13 to shift register output signal SO1.

The direction circuit 404 provides two direction signals through direction signal lines 408 to set the forward/reverse shifting direction of shift register 402. The direction circuit 404 receives a repeating series of timing pulses from timing signals T3-T5. In addition, direction circuit 404 receives control pulses in control signal CSYNC on control line 430. If direction circuit 404 receives a control pulse in control signal CSYNC coincident with a timing pulse in timing signal T4, direction circuit 404 provides a low voltage level reverse direction signal and a high voltage level forward direction signal to shift and provide addresses in the forward direction. The forward direction signals set shift register 402 for shifting in the forward direction from shift register output signal SO1 to shift register output signal SO13. If direction circuit 404 does not receive a control pulse coincident with a timing pulse in timing signal T4, direction circuit 404 provides a low voltage level forward direction signal and a high voltage level reverse direction signal to shift and provide addresses in the reverse direction. The reverse direction signals set shift register 402 for shifting in the reverse direction, from shift register output signal SO13 to shift register output signal SO1.

The logic array 406 receives shift register output signals SO1-SO13 on shift register output signal lines 410*a*-410*m* and timing pulses from timing signals T3-T5 on timing signal lines 434, 422 and 436. In response to a single high voltage level output signal in the shift register output signals SO1-SO13 and the timing pulses from timing signals T3-T5, logic array 406 provides two low voltage level address signals out of the seven address signals A1, A2, . . . A7.

The logic array 406 receives a timing pulse from timing signal T3 that turns on evaluation prevention transistor 442*a* to pull the evaluation signal line 474 to a low voltage level and turn off address evaluation transistors 440*a*-440*m*. Also, the timing pulse from timing signal T3 charges address lines 472*a*-472*g* to high voltage levels through address line pre-charge transistors 438*a*-438*g*. In one embodiment, the timing pulse from timing signal T3 is replaced by the timing pulse from timing signal T4 to charge address lines 472*a*-472*g* to high voltage levels through address line pre-charge transistors 438*a*-438*g*.

The timing pulse from timing signal T4 turns on evaluation prevention transistor 442*b* to pull evaluation signal line 474 to a low voltage level and turn off address evaluation transistors 440*a*-440*m*. The shift register output signals SO1-SO13 settle to valid output signals during the timing pulse from timing signal T4 and a single high voltage level output signal in the shift register output signals SO1-SO13 is provided to the gates of two address transistors 446, 448, . . . 470 in logic array 406. A timing pulse from timing signal T5 charges the evaluation signal line 474 to a high voltage level to turn on address evaluation transistors 440*a*-440*m*. As address evaluation transistors 440*a*-440*m* are turned on, the two address transistors 446, 448, . . . 470 in logic array 406 that receive the high voltage level shift register output signal SO1-SO13 conduct to discharge the corresponding address lines 472*a*-472*g*. The corresponding address lines 472*a*-472*g* are actively pulled low through conducting address transistors 446, 448, . . . 470 and one of the conducting address evaluation transistors 440*a*-440*m*. The other address lines 472*a*-472*g* remain charged to a high voltage level.

The logic array 406 provides two low voltage level address signals out of the seven address signals A1, A2, . . . A7 in each address time slot. If shift register output signal SO1 is at a high voltage level, address one transistors 446*a* and 446*b* conduct to pull address lines 472*a* and 472*b* to low voltage levels and provide active low address signals A1 and A2, and so on for each shift register output signal SO2-SO13. The active low address signals A1, A2, . . . A7 for each of the thirteen address time slots are set out in the following table:

| Address | Active low address signals |
|---|---|
| 1 | ~A1 and ~A2 |
| 2 | ~A1 and ~A3 |
| 3 | ~A1 and ~A4 |
| 4 | ~A1 and ~A5 |
| 5 | ~A1 and ~A6 |
| 6 | ~A1 and ~A7 |
| 7 | ~A2 and ~A3 |
| 8 | ~A2 and ~A4 |
| 9 | ~A2 and ~A5 |
| 10 | ~A2 and ~A6 |
| 11 | ~A2 and ~A7 |
| 12 | ~A3 and ~A4 |
| 13 | ~A3 and ~A5 |

In another embodiment, logic array 406 can provide active address signals A1, A2, . . . A7 for each of thirteen address time slots as set out in the following table:

| Address | Active low address signals |
|---|---|
| 1 | ~A1 and ~A3 |
| 2 | ~A1 and ~A4 |
| 3 | ~A1 and ~A5 |
| 4 | ~A1 and ~A6 |
| 5 | ~A2 and ~A4 |
| 6 | ~A2 and ~A5 |
| 7 | ~A2 and ~A6 |
| 8 | ~A2 and ~A7 |

-continued

| Address | Active low address signals |
|---|---|
| 9 | ~A3 and ~A5 |
| 10 | ~A3 and ~A6 |
| 11 | ~A3 and ~A7 |
| 12 | ~A4 and ~A6 |
| 13 | ~A4 and ~A7 |

Also, in other embodiments, the logic array 406 can include address transistors that provide any suitable number of low voltage level address signals A1, A2, . . . A7 for each high voltage level output signal SO1-SO13 and in any suitable sequence of low voltage level address signals A1, A2, . . . A7. In addition, in other embodiments, logic array 406 can include any suitable number of address lines to provide any suitable number of address signals in any suitable number of address timeslots.

In operation, a repeating series of five timing pulses is provided from timing signals T1-T5. Each of the timing signals T1-T5 provides one timing pulse in each series of five timing pulses. The timing pulse from timing signal T1 is followed by the timing pulse from timing signal T2, which is followed by the timing pulse from timing signal T3, which is followed by the timing pulse from timing signal T4, which is followed by the timing pulse from timing signal T5. This series of five timing pulses is repeated in the repeating series of five timing pulses.

In one series of five timing pulses, direction circuit 404 receives a timing pulse from timing signal T3 in third pre-charge signal PRE3 that charges both forward and reverse direction lines 408 to high voltage levels. The direction circuit 404 receives a reduced voltage level timing pulse from timing signal T4 in third evaluation signal EVAL3. If direction circuit 404 receives a control pulse in control signal CSYNC coincident with (at the same time as) the reduced voltage level timing pulse from timing signal T4 in third evaluation signal EVAL3, direction circuit 404 discharges the reverse direction line 408. If direction circuit 404 receives a low voltage level control signal CSYNC coincident with the reduced voltage level timing pulse from timing signal T4 in third evaluation signal EVAL3, the reverse direction line 408 remains charged to a high voltage level.

Next, direction circuit 404 receives a reduced voltage level timing pulse from timing signal T5 in fourth evaluation signal EVAL4. If the reverse direction line 408 is discharged, the forward direction line 408 remains charged to a high voltage level and the signal levels on the direction lines 408 set up shift register 402 to shift in the forward direction. If the reverse direction line 408 is charged, the forward direction line 408 discharges to a low voltage level and the signal levels on the direction lines 408 set up shift register 402 to shift in the reverse direction. The direction signals on direction lines 408 are set during each series of five timing pulses.

The direction is set in one series of five timing pulses and shift register 402 can be initiated in the next series of five timing pulses. To initiate shift register 402, shift register 402 receives a timing pulse from timing signal T1 in first pre-charge signal PRE1. The timing pulse in first pre-charge signal PRE1 pre-charges an internal node in each of the thirteen shift register cells 403*a*-403*m*. The shift register 402 receives a reduced voltage level timing pulse from timing signal T2 in first evaluation signal EVAL1. If a control pulse in control signal CSYNC is received by shift register 402 coincident with the timing pulse in first evaluation signal EVAL1, shift register 402 discharges the internal node of one of the thirteen shift register cells to provide a low voltage level at the discharged internal node. If the control signal CSYNC remains at a low voltage level coincident with the timing pulse in first evaluation signal EVAL1, the internal node in each of the thirteen shift register cells remains at a high voltage level.

Shift register 402 receives a timing pulse from timing signal T3 in second pre-charge signal PRE2. The timing pulse in second pre-charge signal PRE2 pre-charges each of the thirteen shift register output lines 410*a*-410*m* to provide high voltage level shift register output signals SO1-SO13. Shift register 402 receives a reduced voltage level timing pulse from timing signal T4 in second evaluation signal EVAL2. If the internal node in a shift register cell 403 is at a low voltage level, such as after receiving the control pulse from control signal CSYNC coincident with the timing pulse in first evaluation signal EVAL1, shift register 402 maintains the shift register output signal SO1-SO13 at the high voltage level. If the internal node in a shift register cell 403 is at a high voltage level, such as in all other shift register cells 403, shift register 402 discharges the shift register output line 410*a*-410*m* to provide low voltage level shift register output signals SO1-SO13. The shift register 402 is initiated in one series of the five timing pulses. The shift register output signals SO1-SO13 become valid during the timing pulse from timing signal T4 in second evaluation signal EVAL2 and remain valid until the timing pulse from timing signal T3 in the next series of five timing pulses. In each subsequent series of the five timing pulses, shift register 402 shifts the high voltage level shift register output signal SO1-SO13 from one shift register cell 403 to the next shift register cell 403.

The logic array 406 receives the shift register output signals SO1-SO13. In one embodiment, logic array 406 receives the timing pulse from timing signal T3 to pre-charge address lines 472*a*-472*g* and turn off address evaluation transistors 440*a*-440*m*. In one embodiment, logic array 406 receives the timing pulse from timing signal T3 to turn off address evaluation transistors 440*a*-440*m* and a timing pulse from timing signal T4 to pre-charge address lines 472*a*-472*m*.

Logic array 406 receives the timing pulse from timing signal T4 to turn off address evaluation transistors 440*a*-440*m* as shift register output signals SO1-SO13 settle to valid shift register output signals SO1-SO13. If shift register 402 is initiated, one shift register output signal SO1-SO13 remains at a high voltage level after the timing pulse from timing signal T4. Logic array 406 receives the timing pulse from timing signal T5 to charge evaluation signal line 474 and turn on address evaluation transistors 440*a*-440*m*. The address transistors 446, 448, . . . 470 that receive the high voltage level shift register output signal SO1-SO13 are turned on to pull two of the seven address lines 472*a*-472*g* to low voltage levels. The two low voltage level address signals in address signals A1, A2, . . . A7 are used to enable firing cells 120 and firing cell subgroups for activation. The address signals A1, A2, . . . A7 become valid during the timing pulse from timing signal T5 and remain valid until the timing pulse from timing signal T3 in the next series of five timing pulses.

If shift register 402 is not initiated, all shift register output lines 410*a*-410*m* are discharged to provide low voltage level shift register output signals SO1-SO13. The low voltage level shift register output signals SO1-SO13 turn off address transistors 446, 448, . . . 470 and address lines 472*a*-472*g* remain charged to provide high voltage level address signals A1, A2, . . . A7. The high voltage level address signals A1, A2, . . . A7 prevent firing cells 120 and firing cell subgroups from being enabled for activation.

Figure 10:
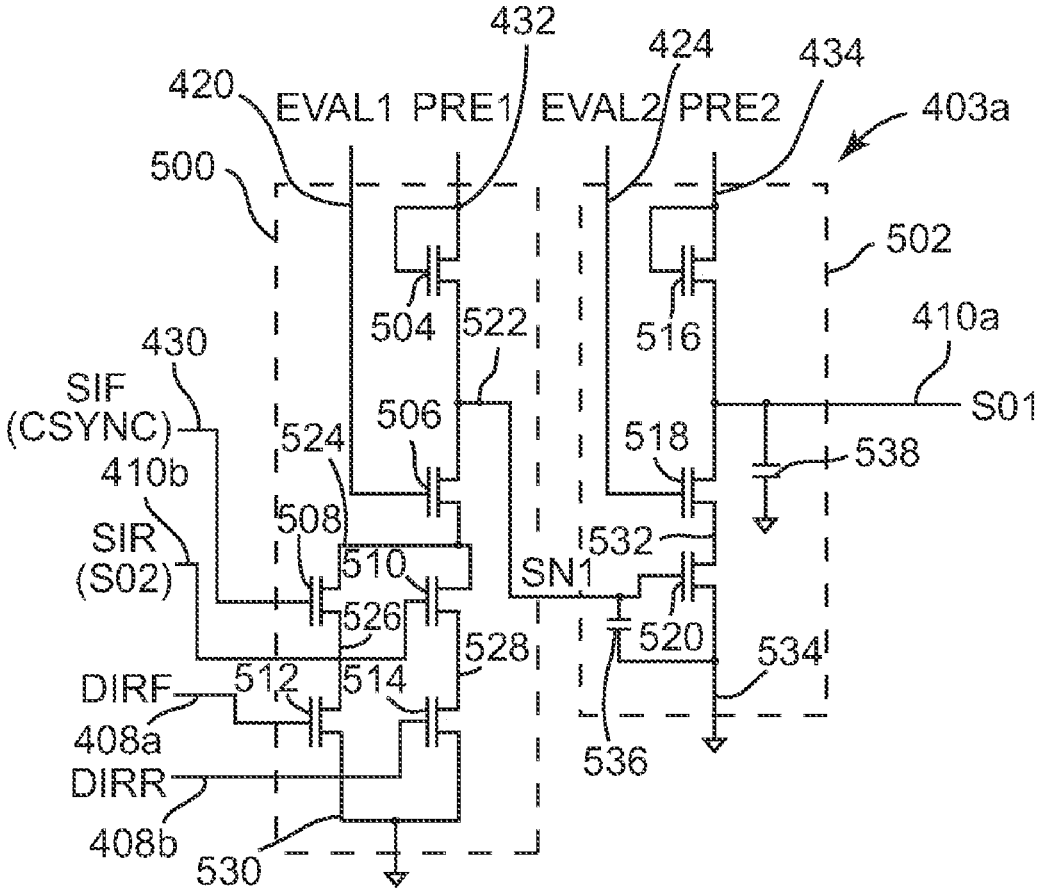
FIG. 10 is a diagram illustrating one shift register cell.

FIG. 10 is a diagram illustrating one shift register cell 403*a* in shift register 402. Shift register 402 includes thirteen shift register cells 403*a*-403*m* that provide the thirteen shift register output signals SO1-SO13. Each shift register cell 403*a*-403*m* provides one of the shift register output signals SO1-SO13 and each shift register cell 403*a*-403*m* is similar to shift register cell 403*a*. The thirteen shift register cells 403 are electrically coupled in series to provide shifting in the forward and reverse directions. In other embodiments, shift register 402 can include any suitable number of shift register cells 403 to provide any suitable number of shift register output signals.

The shift register cell 403*a* includes a first stage that is an input stage, indicated in dashed lines at 500, and a second stage that is an output stage, indicated in dashed lines at 502. The first stage 500 includes a first pre-charge transistor 504, a first evaluation transistor 506, a forward input transistor 508, a reverse input transistor 510, a forward direction transistor 512 and a reverse direction transistor 514. The second stage 502 includes a second pre-charge transistor 516, a second evaluation transistor 518 and an internal node transistor 520.

In the first stage 500, the gate and one side of the drain-source path of first pre-charge transistor 504 is electrically coupled to timing signal line 432 that provides timing signal T1 to shift register 402 as first pre-charge signal PRE1. The other side of the drain-source path of first pre-charge transistor 504 is electrically coupled to one side of the drain-source path of first evaluation transistor 506 and the gate of internal node transistor 520 through internal node line 522. The internal node line 522 provides shift register internal node signal SN1 between stages 500 and 502 to the gate of internal node transistor 520.

The gate of first evaluation transistor 506 is electrically coupled to first evaluation signal line 420 that provides the reduced voltage level T2 timing signal to shift register 402 as first evaluation signal EVAL1. The other side of the drain-source path of first evaluation transistor 506 is electrically coupled to one side of the drain-source path of forward input transistor 508 and one side of the drain-source path of reverse input transistor 510 through internal path 524.

The other side of the drain-source path of forward input transistor 508 is electrically coupled to one side of the drain-source path of forward direction transistor 512 at 526, and the other side of the drain-source path of reverse input transistor 510 is electrically coupled to one side of the drain-source path of reverse direction transistor 514 at 528. The other sides of the drain-source paths of forward direction transistor 512 and reverse direction transistor 514 are electrically coupled to a reference, such as ground, at 530.

The gate of the forward direction transistor 512 is electrically coupled to direction line 408*a* that receives a forward direction signal DIRF from direction circuit 404. The gate of the reverse direction transistor 514 is electrically coupled to direction line 408*b* that receives a reverse direction signal DIRR from direction circuit 404.

In the second stage 502, the gate and one side of the drain-source path of second pre-charge transistor 516 are electrically coupled to timing signal line 434 that provides timing signal T3 to shift register 402 as second pre-charge signal PRE2. The other side of the drain-source path of second pre-charge transistor 516 is electrically coupled to one side of the drain-source path of second evaluation transistor 518 and to shift register output line 410*a*. The other side of the drain-source path of second evaluation transistor 518 is electrically coupled to one side of the drain-source path of internal node transistor 520 at 532 and the gate of second evaluation transistor 518 is electrically coupled to second evaluation signal line 424 to provide the reduced voltage level T4 timing signal to shift register 402 as second evaluation signal EVAL2. The gate of internal node transistor 520 is electrically coupled to internal node line 522 and the other side of the drain-source path of internal node transistor 520 is electrically coupled to a reference, such as ground, at 534. The gate of the internal node transistor 520 includes a capacitance at 536 for storing the shift register cell internal node signal SN1. The shift register output signal line 410*a* includes a capacitance at 538 for storing the shift register output signal SO1.

Each shift register cell 403*a*-403*m* in the series of thirteen shift register cells 403 is similar to shift register cell 403*a*. The gate of the forward direction transistor 508 in each shift register cell 403*a*-403*m* is electrically coupled to the control line 430 or one of the shift register output lines 410*a*-410*l* to shift in the forward direction. The gate of the reverse direction transistor 510 in each shift register cell 403*a*-403*m* is electrically coupled to the control line 430 or one of the shift register output lines 410*b*-410*m* to shift in the reverse direction. The shift register output signal lines 410 are electrically coupled to one forward transistor 508 and one reverse transistor 510, except for shift register output signal lines 410*a* and 410*m*. Shift register output signal line 410*a* is electrically coupled to a forward direction transistor 508 in shift register cell 403*b*, but not a reverse direction transistor 510. Shift register output signal line 410*m* is electrically coupled to a reverse direction transistor 510 in shift register cell 403*l*, but not a forward direction transistor 508.

The shift register cell 403*a* is the first shift register cell in the series of thirteen shift register cells 403*a*-403*m* as shift register 402 shifts in the forward direction. The gate of forward input transistor 508 in shift register cell 403*a* is electrically coupled to control signal line 430 to receive control signal CSYNC. The gate of the forward input transistor in each of the other shift register cells 403*b*-403*m* is electrically coupled to receive the preceding shift register output signal. For example, the gate of the forward input transistor in the second shift register cell 403*b* is electrically coupled to shift register output line 410*a* to receive shift register output signal SO1 and so on, up to and including the gate of the forward input transistor in the thirteenth shift register cell 403*m* that is electrically coupled to shift register output line 410*l* to receive shift register output signal SO12.

The shift register cell 403*m* is the first shift register cell in the series of thirteen shift register cells 403*a*-403*m* as shift register 402 shifts in the reverse direction. The gate of the reverse input transistor of the shift register cell 403*m* is electrically coupled to control signal line 430 to receive control signal CSYNC. The gate of the reverse input transistor in each of the other shift register cells 403*a*-403*l* is electrically coupled to receive the following shift register output signal. For example, the gate of the reverse input transistor of the shift register cell 403*l* is electrically coupled to shift register output line 410*m* to receive shift register output signal SO13 and so on, up to and including the gate of reverse input transistor 510 in shift register cell 403*a* that is electrically coupled to shift register output line 410*b* to receive shift register output signal SO2. Shift register output lines 410*a*-410*m* are also electrically coupled to logic array 406.

Shift register 402 receives a control pulse in control signal CSYNC coincident with a timing pulse in the reduced voltage level T2 timing signal of first evaluation signal EVAL1 and provides a single high voltage level shift register output signal SO1 or S13. As described above and in detail below, the shifting direction of shift register 402 is set in response to direction signals DIRF and DIRR, which are generated during timing pulses in timing signals T3-T5 based on the control signal CSYNC at 430. If shift register 402 is shifting in the forward direction, shift register 402 sets shift register output line 410*a* and shift register output signal SO1 to a high voltage level in response to the control pulse and timing pulses on timing signals T1-T4. If shift register 402 is shifting in the reverse direction, shift register 402 sets shift register output line 410*m* and shift register output signal SO13 to a high voltage level in response to the control pulse and timing pulses in timing signal T1-T4. The high voltage level output signal SO1 or SO13 is shifted through shift register 402 from one shift register cell 403 to the next shift register cell 403 in response to timing pulses in timing signals T1-T4.

The shift register 402 shifts in the control pulse and shifts the single high level output signal from one shift register cell 403 to the next shift register cell 403 using two pre-charge operations and two evaluate operations. The first stage 500 of each shift register cell 403 receives forward direction signal DIRF and reverse direction signal DIRR. Also, the first stage 500 of each shift register 403 receives a forward shift register input signal SIF and a reverse shift register input signal SIR. All shift register cells 403 in shift register 402 are set to shift in the same direction and at the same time as timing pulses are received in timing signals T1-T4.

The first stage 500 of each shift register cell 403 shifts in either the forward shift register input signal SIF or the reverse shift register input signal SIR. The voltage level of the selected shift register input signal SIF or SIR is provided as the shift register output signal SO1-SO13. The first stage 500 of each shift register cell 403 pre-charges internal node line 522 during a timing pulse from timing signal T1 and evaluates the selected shift register input signal SIF or SIR during a timing pulse from timing signal T2. The second stage 502 in each shift register cell 403 pre-charges shift register output lines 410*a*-410*m* during a timing pulse from timing signal T3 and evaluates the internal node signal SN (e.g., SN1) during a timing pulse from timing signal T4.

The direction signals DIRF and DIRR set the forward/reverse direction of shifting in shift register cell 403*a* and all other shift register cells 403 in shift register 402. Shift register 402 shifts in the forward direction if forward direction signal DIRF is at a high voltage level and reverse direction signal DIRR is at a low voltage level. Shift register 402 shifts in the reverse direction if reverse direction signal DIRR is at a high voltage level and forward direction signal DIRF is at a low voltage level.

In operation of shifting shift register cell 403*a* in the forward direction, forward direction signal DIRF is set to a high voltage level and reverse direction signal DIRR is set to a low voltage level. The high voltage level forward direction signal DIRF turns on forward direction transistor 512 and the low voltage level reverse direction signal DIRR turns off reverse direction transistor 514. A timing pulse from timing signal T1 is provided to shift register 402 in first pre-charge signal PRE1 to charge internal node line 522 to a high voltage level through first pre-charge transistor 504. Next, a timing pulse from timing signal T2 is provided to resistor divide network 412 and a reduced voltage level T2 timing pulse is provided to shift register 402 in first evaluation signal EVAL1. The timing pulse in first evaluation signal EVAL1 turns on first evaluation transistor 506. If the forward shift register input signal SIF is at a high voltage level, forward input transistor 508 is turned on and with forward direction transistor 512 already turned on, internal node line 522 is discharged to provide a low voltage level internal node signal SN1. The internal node line 522 is discharged through first evaluation transistor 506, forward input transistor 508 and forward direction transistor 512. If the forward shift register input signal SIF is at a low voltage level, forward input transistor 508 is turned off and internal node line 522 remains charged to provide a high voltage level internal node signal SN1. Reverse shift register input signal SIR controls reverse input transistor 510. However, reverse direction transistor 514 is turned off such that internal node line 522 cannot be discharged through reverse input transistor 510.

The internal node signal SN1 on internal node line 522 controls internal node transistor 520. A low voltage level internal node signal SN1 turns off internal node transistor 520 and a high voltage level internal node signal SN1 turns on internal node transistor 520.

A timing pulse from timing signal T3 is provided to shift register 402 as second pre-charge signal PRE2, which charges shift register output line 410*a* to a high voltage level through second pre-charge transistor 516. Next, a timing pulse from timing signal T4 is provided to a resistor divide network 414 and a reduced voltage level T4 timing pulse is provided to shift register 402 as second evaluation signal EVAL2. The timing pulse in second evaluation signal EVAL2 turns on second evaluation transistor 518. If internal node transistor 520 is off, shift register output line 410*a* remains charged to a high voltage level. If internal node transistor 520 is on, shift register output line 410*a* is discharged to a low voltage level. The shift register output signal SO1 is the high/low inverse of the internal node signal SN1, which is the high/low inverse of the forward shift register input signal SIF. Thus, the level of the forward shift register input signal SIF is shifted to the shift register output signal SO1.

In shift register cell 403*a*, the forward shift register input signal SIF is control signal CSYNC on control line 430. To discharge internal node 522 to a low voltage level, a control pulse in control signal CSYNC is provided at the same time as a timing pulse in first evaluation signal EVAL1. The control pulse in control signal CSYNC that is coincident with the timing pulse from timing signal T2 initiates shift register 402 for shifting in the forward direction.

In operation of shifting shift register cell 403*a* in the reverse direction, forward direction signal DIRF is set to a low voltage level and reverse direction signal DIRR is set to a high voltage level. The low voltage level forward direction signal DIRF turns off forward direction transistor 512 and the high voltage level reverse direction signal DIRR turns on reverse direction transistor 514. A timing pulse from timing signal T1 is provided in first pre-charge signal PRE1 to charge internal node line 522 to a high voltage level through first pre-charge transistor 504. Next, a timing pulse from timing signal T2 is provided to resistor divide network 412 and a reduced voltage level T2 timing pulse is provided in first evaluation signal EVAL1. The timing pulse in first evaluation signal EVAL1 turns on first evaluation transistor 506. If the reverse shift register input signal SIR is at a high voltage level, reverse input transistor 510 is turned on and with reverse direction transistor 514 already turned on internal node line 522 is discharged to provide a low voltage level internal node signal SN1. The internal node line 522 is discharged through first evaluation transistor 506, reverse input transistor 510 and reverse direction transistor 514. If the reverse shift register input signal SIR is at a low voltage level, reverse input transistor 510 is turned off and internal node line 522 remains charged to provide a high voltage level internal node signal SN1. Forward shift register input signal SIF controls forward input transistor 508. However, forward direction transistor 512 is turned off such that internal node line 522 cannot be discharged through forward input transistor 508.

A timing pulse from timing signal T3 is provided in second pre-charge signal PRE2, which charges shift register output line 410*a* to a high voltage level through second pre-charge resistor 516. Next a timing pulse from timing signal T4 is provided to resistor divide network 414 and a reduced voltage level T4 timing pulse is provided in second evaluation signal EVAL2. The timing pulse in second evaluation signal EVAL2 turns on second evaluation transistor 518. If internal node transistor 520 is off, shift register output line 410*a* remains charged to a high voltage level. If internal node transistor 520 is on, shift register output line 410*a* is discharged to a low voltage level. The shift register output signal SO1 is the high/low inverse of the internal node signal SN1, which is the high/low inverse of the reverse shift register input signal SIR. Thus, the level of the reverse shift register input signal SIR is shifted to the shift register output signal SO1.

In shift register cell 403*a*, the reverse shift register input signal SIR is shift register output signal SO2 on shift register output line 410*b*. In shift register cell 403*m*, the reverse shift register input signal SIR is control signal CSYNC on control line 430. To discharge internal node line 522 in shift register cell 403*m* to a low voltage level, a control pulse in control signal CSYNC is provided at the same time as a timing pulse in the first evaluation signal EVAL1. The control pulse in control signal CSYNC that is coincident with the timing pulse from timing signal T2 initiates shift register 402 for shifting in the reverse direction from shift register cell 403*m* toward shift register cell 403*a*.

Figure 11:
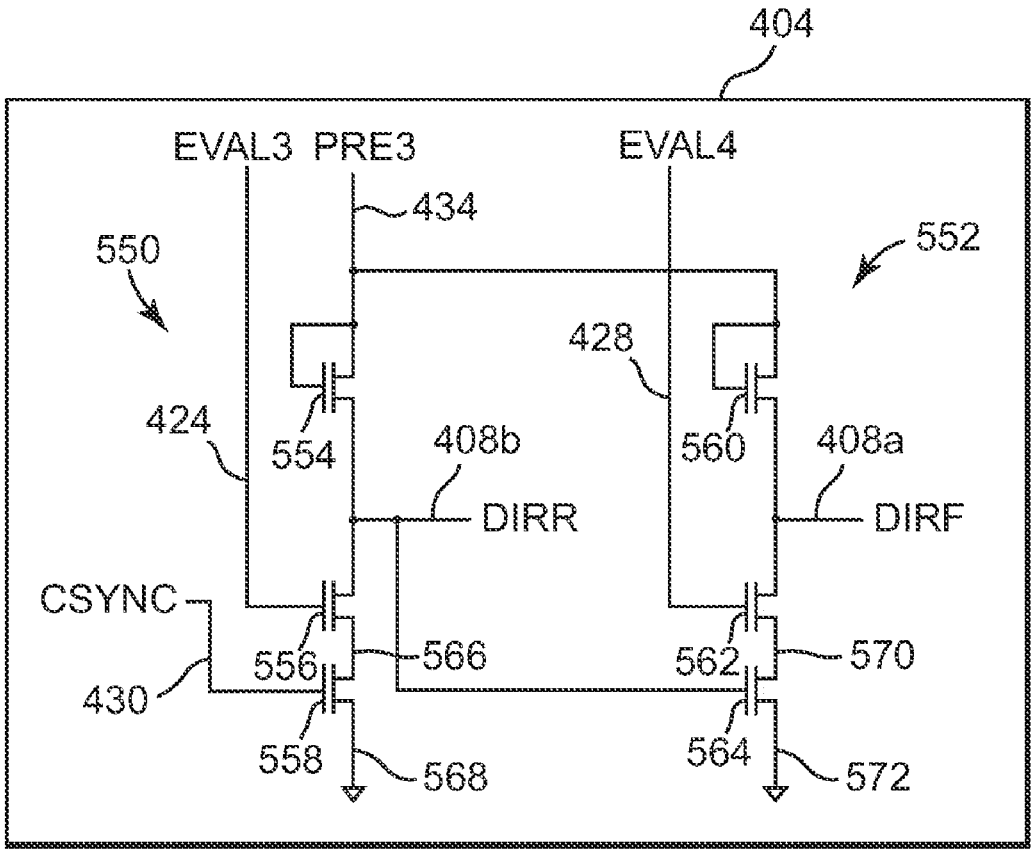
FIG. 11 is a diagram illustrating one embodiment of a direction circuit.

FIG. 11 is a diagram illustrating one embodiment of the direction circuit 404. The direction circuit 404 includes a reverse direction signal stage 550 and a forward direction signal stage 552. The reverse direction signal stage 550 includes a pre-charge transistor 554, an evaluation transistor 556 and a control transistor 558. The forward direction signal stage 552 includes a pre-charge transistor 560, an evaluation transistor 562 and a control transistor 564.

The gate and one side of the drain-source path of pre-charge transistor 554 are electrically coupled to timing signal line 434. The timing signal line 434 provides timing signal T3 to direction circuit 404 as third pre-charge signal PRE3. The other side of the drain-source path of pre-charge transistor 554 is electrically coupled to one side of the drain-source path of evaluation transistor 556 via direction signal line 408*b*. The direction signal line 408*b* provides the reverse direction signal DIRR to the gate of the reverse direction transistor in each shift register cell, similar to the gate of reverse direction transistor 514 in shift register cell 403*a* of FIG. 10. The gate of evaluation transistor 556 is electrically coupled to the evaluation signal line 424 that provides the reduced voltage level T4 timing signal to direction circuit 404 as third evaluation signal EVAL3. The other side of the drain-source path of evaluation transistor 556 is electrically coupled to the drain-source path of control transistor 558 at 566. The drain-source path of control transistor 558 is also electrically coupled to a reference, such as ground, at 568. The gate of control transistor 558 is electrically coupled to control line 430 to receive control signal CSYNC.

The gate and one side of the drain-source path of pre-charge transistor 560 are electrically coupled to timing signal line 434. The other side of the drain-source path pre-charge transistor 560 is electrically coupled to one side of the drain-source path of evaluation transistor 562 via direction signal line 408*a*. The direction signal line 408*a* provides the forward direction signal DIRF to the gate of the forward direction transistor in each shift register cell, similar to the gate of forward direction transistor 512 in shift register cell 403*a* of FIG. 10. The gate of evaluation transistor 562 is electrically coupled to evaluation signal line 428 that provides the reduced voltage level T5 timing signal to direction circuit 404 as fourth evaluation signal EVAL4. The other side of the drain-source path of evaluation transistor 562 is electrically coupled to the drain-source path of control transistor 564 at 570. The drain-source path of control transistor 564 is electrically coupled to a reference, such as ground, at 572. The gate of control transistor 564 is electrically coupled to direction signal line 408*b* to receive reverse direction signal DIRR.

The direction signals DIRF and DIRR set the direction of shifting in shift register 402. If forward direction signal DIRF is set to a high voltage level and reverse direction signal DIRR is set to a low voltage level, forward direction transistors, such as forward direction transistor 512, are turned on and reverse direction transistors, such as reverse direction transistor 514, are turned off and shift register 402 shifts in the forward direction. If forward direction signal DIRF is set to a low voltage level and reverse direction signal DIRR is set to a high voltage level, forward direction transistors, such as forward direction transistor 512, are turned off and reverse direction transistors, such as reverse direction transistor 514, are turned on and shift register 402 shifts in the reverse direction. The direction signals DIRF and DIRR are set during timing pulses in timing signals T3, T4 and T5.

In operation, timing signal line 434 provides a timing pulse in timing signal T3 to direction circuit 404 in third pre-charge signal PRE3. The timing pulse in third pre-charge signal PRE3 charges the forward direction signal line 408*a* and the reverse direction signal line 408*b* to high voltage levels. A timing pulse in timing signal T4 is provided to resistor divide network 414 that provides a reduced voltage level T4 timing pulse to direction circuit 404 in third evaluation signal EVAL3. The timing pulse in third evaluation signal EVAL3 turns on evaluation transistor 556. If a control pulse in control signal CSYNC is provided to the gate of control transistor 558 at the same time as the timing pulse in third evaluation signal EVAL3 is provided to evaluation transistor 556, reverse direction signal line 408*b* discharges to a low voltage level. If the control signal CSYNC remains at a low voltage level as the timing pulse in the third evaluation signal EVAL3 is provided to evaluation transistor 556, reverse direction signal line 408*b* remains charged to a high voltage level.

A timing pulse in timing signal T5 is provided to resistor divide network 416 that provides a reduced voltage level T5 timing pulse to direction circuit 404 in fourth evaluation signal EVAL4. The timing pulse in fourth evaluation signal EVAL4 turns on evaluation transistor 562. If reverse direction signal DIRR is at a high voltage level, forward direction signal line 408*a* discharges to a low voltage level. If reverse direction signal DIRR is at a low voltage level, forward direction signal line 408*a* remains charged to a high voltage level. The direction signals DIRR and DIRF remain valid during timing pulses in timing signals T1 and T2, until the next timing pulse in timing signal T3.

In another embodiment, the gate and one side of the drain-source path of pre-charge transistor 554 and the gate and one side of the drain-source path of pre-charge transistor 560 are electrically coupled to timing signal line 422 that provides timing signal T4 to direction circuit 404 as third pre-charge signal PRE3, instead of the timing signal line 434 that provides timing signal T3. The gate of evaluation transistor 556 is electrically coupled to the evaluation signal line 428 that provides the reduced voltage level T5 timing signal to direction circuit 404 as third evaluation signal EVAL3, instead of the evaluation signal line 424 that provides the reduced voltage level T4 timing signal. Also, the gate of evaluation transistor 562 is electrically coupled to an evaluation signal line that provides a reduced voltage level T1 timing signal to direction circuit 404 as fourth evaluation signal EVAL4, instead of the evaluation signal line 428 that provides the reduced voltage level T5 timing signal. The direction signals DIRF and DIRR are set during timing pulses in timing signals T4, T5 and T1.

In operation, timing signal line 422 provides a timing pulse in timing signal T4 to direction circuit 404 in third pre-charge signal PRE3. The timing pulse in third pre-charge signal PRE3 charges the forward direction signal line 408*a* and the reverse direction signal line 408*b* to high voltage levels. A timing pulse in timing signal T5 is provided to resistor divide network 416 that provides a reduced voltage level T5 timing pulse to direction circuit 404 in third evaluation signal EVAL3. The timing pulse in third evaluation signal EVAL3 turns on evaluation transistor 556. If a control pulse in control signal CSYNC is provided to the gate of control transistor 558 at the same time as the timing pulse in third evaluation signal EVAL3 is provided to evaluation transistor 556, reverse direction signal line 408*b* discharges to a low voltage level. If the control signal CSYNC remains at a low voltage level as the timing pulse in the third evaluation signal EVAL3 is provided to evaluation transistor 556, reverse direction signal line 408*b* remains charged to a high voltage level.

A timing pulse in timing signal T1 is provided to a resistor divide network that provides a reduced voltage level T1 timing pulse to direction circuit 404 in fourth evaluation signal EVAL4. The timing pulse in fourth evaluation signal EVAL4 turns on evaluation transistor 562. If reverse direction signal DIRR is at a high voltage level, forward direction signal line 408*a* discharges to a low voltage level. If reverse direction signal DIRR is at a low voltage level, forward direction signal line 408*a* remains charged to a high voltage level. The direction signals DIRR and DIRF remain valid during timing pulses in timing signals T2 and T3, until the next timing pulse in timing signal T4.

FIG. 12 is a table illustrating the operation of one embodiment of address generator 400. Address generator 400 receives a repeating series of five timing pulses provided from timing signals T1-T5 at 600. Each of the timing signals T1-T5 provides one timing pulse in each series of five timing pulses. The timing pulse from timing signal T1 at 602 is followed by the timing pulse from timing signal T2 at 604, which is followed by the timing pulse from timing signal T3 at 606, which is followed by the timing pulse from timing signal T4 at 608, which is followed by the timing pulse from timing signal T5 at 610. The series of five timing pulses is repeated starting with the timing pulse from timing signal T1 at 612 followed by the timing pulse from timing signal T2 at 614 and so on.

To initiate shift register 402, shift register 402 receives the timing pulse from timing signal T1 at 602 in first pre-charge signal PRE1. At 616, this pre-charges the internal node SN in each of the thirteen shift register cells 403*a*-403*m*. Next, the shift register 402 receives a reduced voltage level timing pulse from timing signal T2 at 604 in first evaluation signal EVAL1 to determine the internal node SN at 618. If a control pulse in control signal CSYNC at 620 is received by shift register 402 coincident with the timing pulse in first evaluation signal EVAL1, shift register 402 discharges the internal node SN of either the first shift register cell 403*a* or the last shift register cell 403*m* at 618 to provide a low voltage level at the discharged internal node SN. The internal node SN of the first shift register cell 403*a* is discharged if the direction signals DIRR and DIRF set a forward direction and the internal node SN of the last shift register cell 403*m* is discharged if the direction signals DIRR and DIRF set a reverse direction. If the control signal CSYNC at 620 remains at a low voltage level coincident with the timing pulse in first evaluation signal EVAL1, the internal node SN in each of the thirteen shift register cells remains at a high voltage level at 618.

Shift register 402 receives a timing pulse from timing signal T3 at 606 in second pre-charge signal PRE2, which pre-charges each of the thirteen shift register output lines 410*a*-410*m* to provide high voltage level shift register output signals SO1-SO13 at 622. Shift register 402 receives a reduced voltage level timing pulse from timing signal T4 at 608 in second evaluation signal EVAL2. If the internal node in a shift register cell 403 is at a low voltage level, such as after receiving the control pulse from control signal CSYNC at 620 coincident with the timing pulse in first evaluation signal EVAL1, shift register 402 maintains the shift register output signal SO1-SO13 at the high voltage level at 624. If the internal node in a shift register cell 403 is at a high voltage level, such as in all other shift register cells 403, shift register 402 discharges the shift register output line 410*a*-410*m* to provide low voltage level shift register output signals SO1-SO13 at 624. The shift register 402 is initiated in one series of five timing pulses and the shift register output signals SO1-SO13 at 624 become valid during the timing pulse from timing signal T4 at 608 and remain valid until the timing pulse from timing signal T3 in the next series of five timing pulses.

In each subsequent series of five timing pulses from timing signals T1-T5 at 600, shift register 402 shifts the high voltage level shift register output signal SO1-SO13 from one shift register cell 403 to the next shift register cell 403. The next series of five timing pulses begins with shift register 402 receiving the timing pulse from timing signal T1 at 612 in first pre-charge signal PRE1. At 626, this pre-charges the internal node SN in each of the thirteen shift register cells 403*a*-403*m*. Next, the shift register 402 receives a reduced voltage level timing pulse from timing signal T2 at 614 in first evaluation signal EVAL1 to determine the internal nodes SN at 628. The forward shift register input signal SIF or the reverse shift register input signal SIR is shifted into each of the shift register cells 403 based on the direction signals DIRR and DIRF. Pre-charging and evaluating continues as previously described.

Logic array 406 receives the timing pulse from timing signal T3 at 606 to pre-charge address lines 472*a*-472*g* at 630 and turn off address evaluation transistors 440*a*-440*m*. In another embodiment, logic array 406 receives the timing pulse from timing signal T3 at 606 to turn off address evaluation transistors 440*a*-440*m* and a timing pulse from timing signal T4 at 608 to pre-charge address lines 472*a*-472*m*.

The logic array 406 receives the shift register output signals SO1-SO13 and the timing pulse from timing signal T4 at 608, which turns off address evaluation transistors 440*a*-440*m* as the shift register output signals SO1-SO13 settle to valid shift register output signals SO1-SO13. If shift register 402 is initiated, one shift register output signal SO1-SO13 remains at a high voltage level after the timing pulse from timing signal T4 at 608. Logic array 406 receives the timing pulse from timing signal T5 at 610 to evaluate the address signals address signals A1, A2, . . . A7 at 632. The timing pulse from timing signal T5 at 610 charges evaluation signal line 474 and turns on address evaluation transistors 440*a*-440*m*. The address transistors 446, 448, . . . 470 that receive the high voltage level shift register output signal SO1-SO13 are turned on to pull two of the seven address lines 472*a*-472*g* to low voltage levels. The two low voltage level address signals in address signals A1, A2, . . . A7 are used to enable firing cells 120 and firing cell subgroups for activation. The address signals A1, A2, . . . A7 become valid during the timing pulse from timing signal T5 at 610 and remain valid at 634 and 636, during the timing pulses of timing signals T1 at 612 and T2 at 614. The address signals A1, A2, . . . A7 remain valid until the timing pulse from timing signal T3 that follows the timing pulse in timing signal T2 at 614.

If shift register 402 is not initiated, all shift register output lines 410*a*-410*m* are discharged to provide low voltage level shift register output signals SO1-SO13. The low voltage level shift register output signals SO1-SO13 turn off address transistors 446, 448, . . . 470 and address lines 472*a*-472*g* remain charged to provide high voltage level address signals A1, A2, . . . A7. The high voltage level address signals A1, A2, . . . A7 prevent firing cells 120 and firing cell subgroups from being enabled for activation.

Direction circuit 404 provides valid direction signals DIRR and DIRF during the timing pulses of timing signal T2 to provide a forward or reverse sequence of address signals A1, A2, . . . A7. To initiate shift register 402 and provide valid address signals A1, A2, . . . A7 at 634 and 636, direction circuit 404 provides valid direction signals DIRR and DIRF at 638 during the timing pulse of timing signal T2 at 604. To continue the sequence of address signals A1, A2, . . . A7, direction circuit 404 provides valid direction signals DIRR and DIRF at 640 during the timing pulse of timing signal T2 at 614.

Direction circuit 404 receives a control pulse in control signal CSYNC either during the timing pulse from timing signal T4 or during the timing pulse from timing signal T5 to provide valid direction signals DIRR and DIRF during the timing pulses of timing signal T2. The direction signals DIRR and DIRF are valid two timing pulses after the control pulse and the direction signals DIRR and DIRF remain valid for two timing pulses. If the direction signals DIRR and DIRF are initiated via a control pulse at 642 in control signal CSYNC coincident with the timing pulse from timing signal T4 at 608, the direction signals DIRR and DIRF are valid during timing pulses in timing signals T1 at 612 and T2 at 614. If the direction signals DIRR and DIRF are initiated via a control pulse at 644 in control signal CSYNC coincident with the timing pulse from timing signal T5 at 610, the direction signals DIRR and DIRF are valid during the timing pulses in timing signals T2 at 614 and the next timing signal T3.

In one embodiment, direction circuit 404 receives a timing pulse from timing signal T3 at 606 in third pre-charge signal PRE3 that charges both forward and reverse direction lines 408*a* and 408*b* to high voltage levels. The direction circuit 404 receives a reduced voltage level timing pulse from timing signal T4 at 608 in third evaluation signal EVAL3. If direction circuit 404 receives a control pulse in control signal CSYNC at 642 coincident with the reduced voltage level timing pulse from timing signal T4 at 608 in third evaluation signal EVAL3, direction circuit 404 discharges the reverse direction line 408*b*. If direction circuit 404 receives a low voltage level control signal CSYNC coincident with the reduced voltage level timing pulse from timing signal T4 at 608 in third evaluation signal EVAL3, the reverse direction line 408*b* remains charged to a high voltage level.

Next, direction circuit 404 receives a reduced voltage level timing pulse from timing signal T5 at 610 in fourth evaluation signal EVAL4. If the reverse direction line 408*b* is discharged, the forward direction line 408*a* remains charged to a high voltage level and the signal levels on the direction lines 408*a* and 408*b* set shift register 402 to shift in the forward direction. If the reverse direction line 408*b* is charged, the forward direction line 408*a* discharges to a low voltage level and the signal levels on the direction lines 408 set shift register 402 to shift in the reverse direction. The direction signals DIRR and DIRF are valid during timing pulses in timing signals T1 at 612 and T2 at 614. The direction signals DIRR and DIRF are set during each series of five timing pulses to provide the sequence of address signals A1, A2, . . . A7.

In another embodiment, direction circuit 404 receives a timing pulse from timing signal T4 at 608 in third pre-charge signal PRE3 that charges both forward and reverse direction lines 408*a* and 408*b* to high voltage levels. The direction circuit 404 receives a reduced voltage level timing pulse from timing signal T5 at 610 in third evaluation signal EVAL3. If direction circuit 404 receives a control pulse at 644 in control signal CSYNC coincident with the reduced voltage level timing pulse from timing signal T5 at 610 in third evaluation signal EVAL3, direction circuit 404 discharges the reverse direction line 408*b*. If direction circuit 404 receives a low voltage level control signal CSYNC at 644 coincident with the reduced voltage level timing pulse from timing signal T5 at 610 in third evaluation signal EVAL3, the reverse direction line 408*b* remains charged to a high voltage level.

Next, direction circuit 404 receives a reduced voltage level timing pulse from timing signal T1 at 612 in fourth evaluation signal EVAL4. If the reverse direction line 408*b* is discharged, the forward direction line 408*a* remains charged to a high voltage level and the signal levels on the direction lines 408*a* and 408*b* set shift register 402 to shift in the forward direction. If the reverse direction line 408*b* is charged, the forward direction line 408*a* discharges to a low voltage level and the signal levels on the direction lines 408 set shift register 402 to shift in the reverse direction. The direction signals DIRR and DIRF are valid during timing pulses in timing signals T2 at 614 and the next timing signal T3. The direction signals DIRR and DIRF are set during each series of five timing pulses to provide the sequence of address signals A1, A2, . . . A7.

Figure 13:
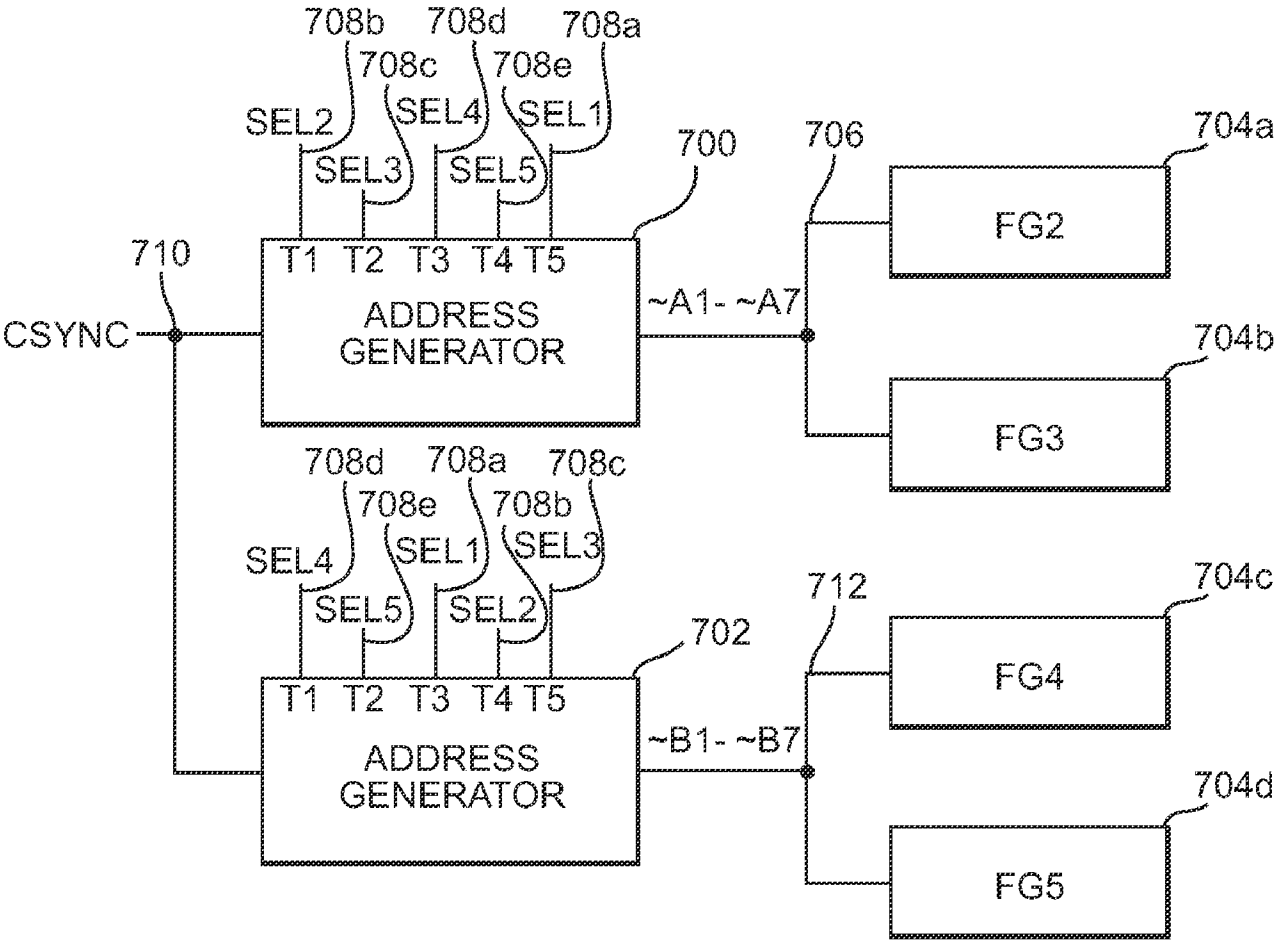
FIG. 13 is a diagram illustrating one embodiment of two address generators and four fire groups in a printhead die.

FIG. 13 is a diagram illustrating one embodiment of two address generators 700 and 702 and four fire groups 704*a*-704*d* in a printhead die 40. South address generator 702 is similar to address generator 400 of FIG. 9 and includes a direction circuit 404 that sets direction signals DIRR and DIRF via a control pulse in control signal CSYNC at 710 that is coincident with a timing pulse in timing signal T4. North address generator 700 is similar to address generator 400 of FIG. 9, except it includes an embodiment of the direction circuit that sets direction signals DIRR and DIRF via a control pulse in control signal CSYNC at 710 that is coincident with a timing pulse in timing signal T5. Fire groups 704*a*-704*d* are similar to fire groups 202*a*-202*d* illustrated in FIG. 7.

The address generator 700 is electrically coupled to fire groups 704*a* and 704*b* through first address lines 706. The address lines 706 provide address signals Al, A2, . . . A7 from address generator 700 to each of the fire groups 704*a* and 704*b*. Also, address generator 700 is electrically coupled to control line 710 that receives and provides control signal CSYNC to address generator 700. In addition, address generator 700 is electrically coupled to select lines 708*a*-708*e*. The select lines 708*a*-708*e* are similar to select lines 212*a*-212*d* illustrated in FIG. 7.

The select lines 708*a*-708*e* receive select signals SEL1, SEL2, . . . SEL5 and provide select signals SEL1, SEL2, . . . SEL5 to address generator 700, as well as to the corresponding fire groups 704*a*-704*d*. The select line 708*a* provides select signal SELL to address generator 700 as timing signal T5. The select line 708*b* provides select signal SEL2 to address generator 700 as timing signal T1. The select line 708*c* provides select signal SEL3 to address generator 700 as timing signal T2. The select line 708*d* provides select signal SEL4 to address generator 700 as timing signal T3, and the select line 708*e* provides select signal SEL5 to address generator 700 as timing signal T4.

The address generator 702 is electrically coupled to fire groups 704*c* and 704*d* through second address lines 712. The second address lines 712 provide address signals B1, B2, . . . B7 from address generator 702 to each of the fire groups 704*c* and 704*d*. Also, address generator 702 is electrically coupled to control line 710 that receives and provides control signal CSYNC to address generator 702. In addition, address generator 702 is electrically coupled to select lines 708*a*-708*e*.

The select lines 708*a*-708*e* provide select signals SEL1, SEL2, . . . SEL6 to address generator 702, as well as to the corresponding fire groups 704*a*-704*d*. The select line 708*a* provides select signal SELL to address generator 702 as timing signal T3. The select line 708*b* provides select signal SEL2 to address generator 702 as timing signal T4. The select line 708*c* provides select signal SEL3 to address generator 702 as timing signal T5. The select line 708*d* provides select signal SEL4 to address generator 702 as timing signal T1, and the select line 708*e* provides select signal SEL5 to address generator 702 as timing signal T2.

The select signals SEL1, SEL2, . . . SEL5 provide a series of five pulses in a repeating series of five pulses. Each of the select signals SEL1, SEL2, . . . SEL5 provides one pulse in the series of five pulses. In one embodiment, a pulse in select signal SEL1 is followed by a pulse in select signal SEL2, which is followed by a pulse in select signal SEL3, which is followed by a pulse in select signal SEL4, which is followed by a pulse in select signal SEL5. After the pulse in select signal SEL5, the series repeats beginning with a pulse in select signal SELL. The control signal CSYNC provides pulses coincident with pulses in select signals SEL1, SEL2, . . . SEL5 to initiate address generators 700 and 702 and to set the direction of shifting in address generators 700 and 702.

The address generator 700 generates address signals Al, A2, . . . A7 in response to select signals SEL1, SEL2, . . . SEL5 at 708*a*-708*e* and control signal CSYNC at 710. The address signals A1, A2, . . . A7 are provided through first address lines 706 to fire groups 704*a* and 704*b* and are valid during timing pulses in timing signals T1 and T2, which corresponds to timing pulses in select signals SEL2 and SEL3. A control pulse in control signal CSYNC at 710 coincident with a timing pulse in timing signal T5, which corresponds to the timing pulse in select signal SEL1, sets the direction signals DIRR and DIRF for shifting address generator 700 in the forward direction. A low voltage level in control signal CSYNC at 710 coincident with a timing pulse in timing signal T5, which corresponds to the timing pulse in select signal SEL1, sets the direction signals DIRR and DIRF for shifting address generator 700 in the reverse direction. A control pulse in control signal CSYNC at 710 coincident with a timing pulse in timing signal T2, which corresponds to the timing pulse in select signal SEL3, initiates address generator 700.

Fire group two (FG2) at 704*a* and fire group three (FG3) at 704*b* receive valid address signals A1, A2, . . . A7 during the timing pulses in select signals SEL2 and SEL3. Fire group FG2 at 704*a* receives the address signals A1, A2, . . . A7 and pulses in select signals SEL1, SEL2 . . . SEL5 for enabling firing cells 120 in selected row subgroups SG2 for activation by fire signal FIRE2. Fire group FG3 at 704*b* receives the address signals A1, A2, . . . A7 and pulses in select signals SEL1, SEL2 . . . SEL5 for enabling firing cells 120 in selected row subgroups SG3 for activation by fire signal FIRE3.

The address generator 702 generates address signals B1, B2, . . . B7 in response to the select signals SEL1, SEL2, . . . SEL5 at 708*a*-708*e* and control signal CSYNC at 710. The address signals B1, B2, . . . B7 are provided through second address lines 712 to fire groups 704*c* and 704*d*. The address signals B1, B2, . . . B7 are valid during timing pulses in timing signals T1 and T2, which corresponds to timing pulses in select signals SEL4 and SEL5. A control pulse in control signal CSYNC at 710 coincident with a timing pulse in timing signal T4, which corresponds to the timing pulse in select signal SEL2, sets the direction signals DIRR and DIRF for shifting address generator 702 in the forward direction. A low voltage level in control signal CSYNC at 710 coincident with a timing pulse in timing signal T4, which corresponds to the timing pulse in select signal SEL2, sets the direction signals DIRR and DIRF for shifting address generator 702 in the reverse direction. A control pulse in control signal CSYNC at 710 coincident with a timing pulse in timing signal T2, which corresponds to the timing pulse in select signal SEL5, initiates address generator 702.

Fire group four (FG4) at 704*c* and fire group five (FG5) at 704*d* receive valid address signals B1, B2, . . . B7 during the pulses in select signals SEL4 and SEL5. Fire group FG4 at 704*c* receives the address signals B1, B2, . . . B7 and pulses in select signals SEL1, SEL2 . . . SEL5 for enabling firing cells 120 in selected row subgroups SG4 for activation by fire signal FIRE4. Fire group FG5 at 704*d* receives the address signals B1, B2, . . . B7 and pulses in select signals SEL1, SEL2 . . . SEL5 for enabling firing cells 120 in selected row subgroups SG5 for activation by fire signal FIRE5.

Firing cells 120 in fire group FG2 at 704*a* and fire group FG3 at 704*b* are selected via pulses in select signals SEL2 and SEL3, respectively, while receiving valid address signals A1, A2, . . . A7. Firing cells 120 in fire group FG4 at 704*c* and fire group FG5 at 704*d* are selected via pulses in select signals SEL4 and SEL5, respectively, while receiving valid address signals B1, B2, . . . B7. In the illustrated embodiment, there is no fire group one (FG1), because address signals are not valid during SEL1.

In one example operation, during one series of five pulses, control pulses in control signal CSYNC at 710 coincident with timing pulses in select signals SEL1 and SEL2 set direction signals for shifting address generators 700 and 702 in the forward direction. The control pulse in control signal CSYNC at 710 coincident with the timing pulse in select signal SEL1 sets the direction signals DIRR and DIRF in address generator 700 for shifting address generator 700 in the forward direction. The control pulse in control signal CSYNC at 710 coincident with the timing pulse in select signal SEL2 sets the direction signals DIRR and DIRF in address generator 702 for shifting address generator 702 in the forward direction.

In the next series of five pulses, control pulses in control signal CSYNC at 710 are provided coincident with timing pulses in select signals SEL1, SEL2, SEL3 and SEL5. The control pulses coincident with timing pulses in select signals SEL1 and SEL2 set the direction signals for shifting address generators 700 and 702 in the forward direction. The control pulse coincident with the timing pulse in select signal SEL3 initiates the address generator 700 for generating address signals A1, A2, . . . A7 and the control pulse coincident with the timing pulse in select signal SEL5 initiates the address generator 702 for generating address signals B1, B2, . . . B7.

During a third series of timing pulses, address generator 700 generates address signals A1, A2, . . . A7 that are valid during timing pulses in select signals SEL2 and SEL3. The valid address signals A1, A2, . . . A7 are used for enabling firing cells 120 in row subgroups SG2 and SG3 in fire groups FG2 and FG3 at 704*a* and 704*b* for activation. Also, during the third series of timing pulses, address generator 702 generates address signals B1, B2, . . . B7 that are valid during timing pulses in select signals SEL4 and SEL5. The valid address signals B1, B2, . . . B7 are used for enabling firing cells 120 in row subgroups SG4 and SG5 in fire groups FG4 and FG5 at 704*c* and 704*d* for activation.

During the third series of timing pulses in select signals SEL1, SEL2, . . . SEL5, the address signals A1, A2, . . . A7 include low voltage level signals that correspond to one of thirteen addresses and the address signals B1, B2, . . . B7 include low voltage level signals that correspond to the same one of thirteen addresses. During each subsequent series of timing pulses from select signals SEL1, SEL2, . . . SEL5, the address signals A1, A2, . . . A7 and the address signals B1, B2, . . . B7 include low voltage level signals that correspond to the same one of thirteen addresses. Each series of timing pulses is an address time slot, such that one of the thirteen addresses is provided during each series of timing pulses.

In forward direction operation, address one is provided first by address generators 700 and 702, followed by address two, and so on through address thirteen. After address thirteen, address generators 700 and 702 provide all high voltage level address signals A1, A2, . . . A7 and B1, B2, . . . B7. Also, during each series of timing pulses from select signals SEL1, SEL2, . . . SEL5, control pulses are provided coincident with timing pulses in select signals SEL1 and SEL2 to continue shifting in the forward direction.

In another example operation, during one series of five pulses, low voltage levels in control signal CSYNC at 710 coincident with timing pulses in select signals SEL1 and SEL2 set direction signals for shifting address generators 700 and 702 in the reverse direction. The low voltage level coincident with the timing pulse in select signal SEL1 sets the direction signals in address generator 700 for shifting address generator 700 in the reverse direction. The low voltage level coincident with the timing pulse in select signal SEL2 sets the direction signals in address generator 702 for shifting address generator 702 in the reverse direction.

In the next series of five pulses, control pulses in control signal CSYNC at 710 are provided coincident with the timing pulses in select signals SEL3 and SEL5. The control pulses coincident with timing pulses in select signals SEL3 and SEL5 initiate the address generators 700 and 702 for generating address signals A1, A2, . . . A7 and B1, B2, . . . B7. The control pulse coincident with the timing pulse in select signal SEL3 initiates address generator 700 and the control pulse coincident with the timing pulse in select signal SEL5 initiates address generator 702.

During a third series of timing pulses, address generator 700 generates address signals A1, A2, . . . A7 that are valid during timing pulses in select signals SEL2 and SEL3. The valid address signals A1, A2, . . . A7 are used for enabling firing cells 120 in row subgroups SG2 and SG3 in fire groups FG2 and FG3 at 704*a* and 704*b*. Address generator 702 generates address signals B1, B2, . . . B7 that are valid during timing pulses in select signals SEL4 and SEL5. The valid address signals B1, B2, . . . B7 are used for enabling firing cells 120 in row subgroups SG4 and SG5 in fire groups FG4 and FG5 at 704*c* and 704*d* for activation.

During the third series of timing pulses in select signals SEL1, SEL2, . . . SEL5, address signals A1, A2, . . . A7 include low voltage level signals that correspond to one of thirteen addresses and address signals B1, B2, . . . B7 include low voltage level signals that correspond to the same one of thirteen addresses. During each subsequent series of timing pulses from select signals SEL1, SEL2, . . . SEL5, address signals A1, A2, . . . A7 and B1, B2, . . . B7 include low voltage level signals that correspond to the same one of thirteen addresses. Each series of timing pulses is an address time slot, such that one of the thirteen addresses is provided during each series of timing pulses.

In reverse direction operation, address thirteen is provided first by address generator 700 and 702, followed by address twelve, and so on through address one. After address one, address generators 700 and 702 provide all high voltage level address signals A1, A2, . . . A7 and B1, B2, . . . B7. Also, during each series of timing pulses from select signals SEL1, SEL2 SEL5, low voltage levels are provided coincident with timing pulses in select signals SEL1 and SEL2 to continue shifting in the reverse direction.

Figure 14:
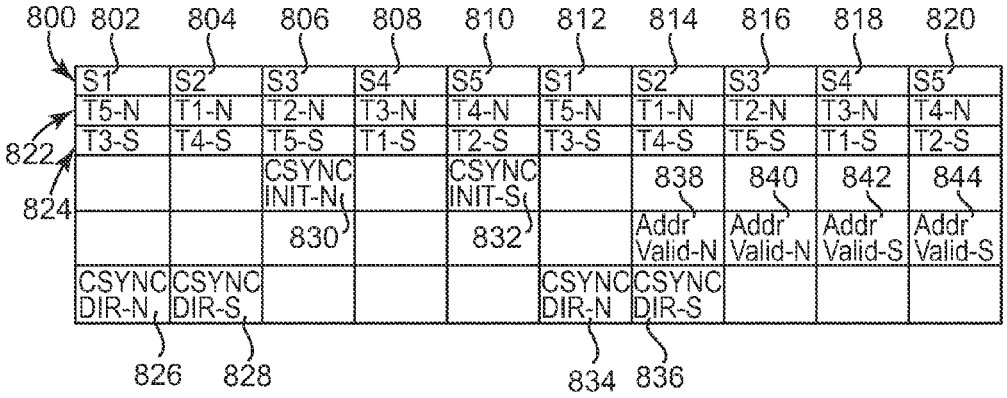
FIG. 14 is a table illustrating the operation of one embodiment of the two address generators of FIG. 13.

FIG. 14 is a table illustrating the operation of one embodiment of address generators 700 and 702 of FIG. 13. Address generators 700 and 702 receive a repeating series of five timing pulses provided from select signals SEL1, SEL2 . . . SEL5 at 800. Each of the select signals SEL1, SEL2 . . . SEL5 at 800 provides one timing pulse in each series of five timing pulses. The timing pulse from select signal SEL1 at 802 is followed by the timing pulse from select signal SEL2 at 804, which is followed by the timing pulse from select signal SEL3 at 806, which is followed by the timing pulse from select signal SEL4 at 808, which is followed by the timing pulse from select signal SEL5 at 810. The series of five timing pulses repeats starting with the timing pulse from select signal SEL1 at 812, which is followed by the timing pulse from select signal SEL2 at 814, which is followed by the timing pulse from select signal SEL3 at 816, which is followed by the timing pulse from select signal SEL4 at 818, which is followed by the timing pulse from select signal SEL5 at 820.

North address generator 700 receives select signals SEL1, SEL2 . . . SEL5 at 822 and south address generator 702 receives select signals SEL1, SEL2 . . . SEL5 at 824. Select signal SEL1 is provided to north address generator 700 as timing signal T5 and to south address generator 702 as timing signal T3. Select signal SEL2 is provided to north address generator 700 as timing signal T1 and to south address generator 702 as timing signal T4. Select signal SEL3 is provided to north address generator 700 as timing signal T2 and to south address generator 702 as timing signal T5. Select signal SEL4 is provided to north address generator 700 as timing signal T3 and to south address generator 702 as timing signal T1. Select signal SEL5 is provided to north address generator 700 as timing signal T4 and to south address generator 702 as timing signal T2.

In the first series of five pulses from select signals SEL1, SEL2 . . . SEL5 at 800, control signals in control signal CSYNC coincident with timing pulses in select signals SEL1 at 802 and SEL2 at 804 set the direction signals in address generators 700 and 702. A control pulse in control signal CSYNC at 826 coincident with a timing pulse in select signal SEL1 at 802 sets direction signals for shifting address generator 700 in the forward direction. A low voltage level in control signal CSYNC at 826 coincident with a timing pulse in select signal SEL1 at 802 sets direction signals for shifting address generator 700 in the reverse direction. A control pulse in control signal CSYNC at 828 coincident with a timing pulse in select signal SEL2 at 804 sets direction signals for shifting address generator 702 in the forward direction. A low voltage level in control signal CSYNC at 828 coincident with a timing pulse in select signal SEL2 at 804 sets direction signals for shifting address generator 702 in the reverse direction.

Control pulses in control signal CSYNC coincident with timing pulses in select signals SEL3 and SEL5 initiate the address generators 700 and 702 for generating address signals A1, A2, . . . A7 and B1, B2, . . . B7. The control pulse in control signal CSYNC at 830 coincident with the timing pulse in select signal SEL3 initiates address generator 700 and the control pulse in control signal CSYNC at 832 coincident with the timing pulse in select signal SEL5 initiates address generator 702.

In the next series of five pulses from select signals SEL1, SEL2 . . . SEL5 at 800, control signals in control signal CSYNC coincident with timing pulses in select signals SEL1 at 812 and SEL2 at 814 set the direction signals for shifting in address generators 700 and 702. A control pulse in control signal CSYNC at 834 coincident with a timing pulse in select signal SEL1 at 812 sets direction signals for shifting address generator 700 in the forward direction. A low voltage level in control signal CSYNC at 834 coincident with a timing pulse in select signal SEL1 at 812 sets direction signals for shifting address generator 700 in the reverse direction. A control pulse in control signal CSYNC at 836 coincident with a timing pulse in select signal SEL2 at 814 sets direction signals for shifting address generator 702 in the forward direction. A low voltage level in control signal CSYNC at 836 coincident with a timing pulse in select signal SEL2 at 814 sets direction signals for shifting address generator 702 in the reverse direction. During each series of timing pulses from select signals SEL1, SEL2 . . . SEL5, control signals are provided coincident with timing pulses in select signals SEL1 and SEL2 to continue shifting in the selected direction.

Address generator 700 generates address signals A1, A2, . . . A7 at 838 and 840 that are valid during timing pulses in select signals SEL2 at 814 and SEL3 at 816. The valid address signals A1, A2, . . . A7 are used for enabling firing cells 120 in row subgroups SG2 and SG3 in fire groups FG2 and FG3 at 704*a* and 704*b*. Address generator 702 generates address signals B1, B2, . . . B7 at 842 and 844 that are valid during timing pulses in select signals SEL4 at 818 and SEL5 at 820. The valid address signals B1, B2, . . . B7 are used for enabling firing cells 120 in row subgroups SG4 and SG5 in fire groups FG4 and FG5 at 704*c* and 704*d* for activation.

Figure 15:
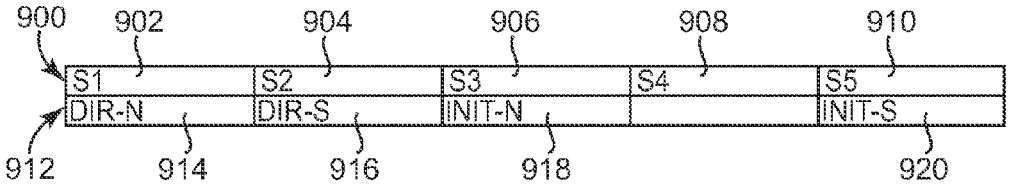
FIG. 15 is a table illustrating control signal sequences in control signal CSYNC for controlling one embodiment of two address generators.

FIG. 15 is a table illustrating control signal sequences in control signal CSYNC at 912 for controlling one embodiment of address generators 700 and 702. Address generators 700 and 702 receive the repeating series of five timing pulses from select signals SEL1, SEL2 . . . SEL5 at 900. Each of the select signals SEL1, SEL2 . . . SEL5 at 900 provides one timing pulse in each series of five timing pulses. The timing pulse from select signal SEL1 at 902 is followed by the timing pulse from select signal SEL2 at 904, which is followed by the timing pulse from select signal SEL3 at 906, which is followed by the timing pulse from select signal SEL4 at 908, which is followed by the timing pulse from select signal SEL5 at 910.

Control signals in control signal CSYNC at 912 coincident with timing pulses in select signals SEL1 at 902 and SEL2 at 904 set the direction signals for shifting in address generators 700 and 702. A control pulse in control signal CSYNC at 914 coincident with a timing pulse in select signal SEL1 at 902 sets the direction signals for shifting address generator 700 in the forward direction. A low voltage level in control signal CSYNC at 914 coincident with a timing pulse in select signal SEL1 at 902 sets the direction signals for shifting address generator 700 in the reverse direction. A control pulse in control signal CSYNC at 916 coincident with a timing pulse in select signal SEL2 at 904 sets the direction signals for shifting address generator 702 in the forward direction. A low voltage level in control signal CSYNC at 916 coincident with a timing pulse in select signal SEL2 at 904 sets the direction signals for shifting address generator 702 in the reverse direction.

Control pulses in control signal CSYNC at 912 coincident with timing pulses in select signals SEL3 at 906 and SEL5 at 910 initiate the address generators 700 and 702 for generating address signals A1, A2, . . . A7 and B1, B2, . . . B7. The control pulse in control signal CSYNC at 918 coincident with the timing pulse in select signal SEL3 at 906 initiates address generator 700 and the control pulse in control signal CSYNC at 920 coincident with the timing pulse in select signal SEL5 at 910 initiates address generator 702. In this embodiment, the timing pulse in select signal SEL4 at 908 is a place holder and control signals in control signal CSYNC at 912 coincident with select signal SEL4 at 908 have no effect on the operation of address generators 700 and 702.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that the present disclosure be limited by the claims and the equivalents thereof.

What is claimed is:

1. A fluid ejection device, comprising:

one control line configured to receive control pulses including a first control pulse sequence having first control pulses and a second control pulse sequence having second control pulses, wherein the timing between the first control pulses is different than the timing between the second control pulses;

a first controller configured to be controlled via the first control pulse sequence received on the one control line to provide first non-image data address signals; and a second controller configured to be controlled via the second control pulse sequence received on the one control line to provide second non-image data address signals.

2. The fluid ejection device of claim 1, wherein the first controller comprises a first direction circuit and the second controller comprises a second direction circuit.

3. The fluid ejection device of claim 1, comprising:

select lines configured to receive select pulses, wherein the first control pulses are coincident with two of the select pulses and the second control pulses are coincident with another two of the select pulses.

4. The fluid ejection device of claim 3, wherein the select lines are five select lines that receive five select pulses.

5. The fluid ejection device of claim 1, wherein the second control pulses are different than the first control pulses.

6. The fluid ejection device of claim 5, comprising:

select lines configured to receive select pulses in a repeating series of select pulses, wherein each of the select lines receives one of the select pulses in the repeating series of select pulses and the first control pulses are coincident with two of the select pulses in the repeating series of select pulses and the second control pulses are coincident with another two of the select pulses in the repeating series of select pulses.

7. The fluid ejection device of claim 6, wherein the select lines are five select lines that receive five select pulses in a repeating series of five select pulses, wherein each of the five select lines receives one of the five select pulses in the repeating series of five select pulses.

8. The fluid ejection device of claim 1, comprising:

first firing cells;

second firing cells; and select lines configured to receive select signals, wherein the first controller is configured to respond to the first control pulse sequence and two of the select signals to initiate a first sequence adapted to enable the first firing cells for activation and to initiate selection of forward and reverse directions for the first sequence and the second controller is configured to respond to the second control pulse sequence and another two of the select signals to initiate a second sequence adapted to enable the second firing cells for activation and to initiate selection of forward and reverse directions for the second sequence.

9. The fluid ejection device of claim 8, wherein the first controller comprises a first direction circuit configured to respond to the first control pulse sequence and at least one of the two select signals to provide forward and reverse direction signals for the first sequence and the second controller comprises a second direction circuit configured to respond to the second control pulse sequence and at least one of the other two select signals to provide forward and reverse direction signals for the second sequence.

10. A fluid ejection device, comprising:

first firing cells;

second firing cells;

one control line configured to receive a control signal including a first control pulse sequence having first control pulses and a second control pulse sequence having second control pulses, wherein the timing between the first control pulses is different than the timing between the second control pulses;

a first select line configured to receive a first non-image data select signal;

a second select line configured to receive a second non-image data select signal;

a third select line configured to receive a third non-image data select signal;

a fourth select line configured to receive a fourth non-image data select signal;

a first controller configured to respond to the first control pulse sequence and the first non-image data select signal to initiate a first sequence of non-image data address signals adapted to enable the first firing cells for activation and to respond to the first control pulse sequence and the second non-image data select signal to initiate selection of forward and reverse directions for the first sequence of non-image data address signals; and a second controller configured to respond to the second control pulse sequence and the third non-image data select signal to initiate a second sequence of non-image data address signals adapted to enable the second firing cells for activation and to respond to the second control pulse sequence and the fourth non-image data select signal to initiate selection of forward and reverse directions for the second sequence of non-image data address signals, wherein the first controller and the second controller receive less than six non-image data select signals.

11. The fluid ejection device of claim 10, wherein one of the first control pulses is coincident with a select signal pulse in the first non-image data select signal to initiate the first sequence of non-image data address signals.

12. The fluid ejection device of claim 10, wherein the first controller and the second controller receive only five non-image data select signals including the first non-image data select signal, the second non-image data select signal, the third non-image data select signal, and the fourth non-image data select signal.

13. The fluid ejection device of claim 10, wherein the first controller comprises a first direction circuit and the second controller comprises a second direction circuit.

14. The fluid ejection device of claim 13, wherein the first direction circuit provides forward and reverse direction signals for the first sequence of non-image data address signals and the second direction circuit provides forward and reverse direction signals for the second sequence of non-image data address signals.

15. The fluid ejection device of claim 10, wherein one of the first control pulses is coincident with a select signal pulse in the second non-image data select signal to select one of the forward and reverse directions for the first sequence of non-image data address signals.

16. The fluid ejection device of claim 15, wherein the control signal is absent the one of the first control pulses coincident with the select signal pulse in the second non-image data select signal to select another one of the forward and reverse directions for the first sequence of non-image data address signals.

17. The fluid ejection device of claim 10, wherein the first controller comprises:

a first direction circuit configured to receive the control signal and the second non-image data select signal and provide a forward direction signal and a reverse direction signal based on whether the control signal includes one of the first control pulses coincident with a select signal pulse in the second non-image data select signal.

18. The fluid ejection device of claim 17, wherein the first controller comprises:

a shift register circuit configured to initiate the first sequence of non-image data address signals in the direction indicated via the forward direction signal and the reverse direction signal in response to another one of the first control pulses being coincident with a select signal pulse in the first non-image data select signal.

19. A fluid ejection device, comprising:

means for receiving a control signal including a first control pulse sequence having first control pulses and a second control pulse sequence having second control pulses, wherein the timing between the first control pulses is different than the timing between the second control pulses;

means for receiving non-image data select signals;

means for providing a first sequence of address signals in a forward direction of the first sequence of address signals and in a reverse direction of the first sequence of address signals based on the first control pulses and only two non-image data select signals; and means for providing a second sequence of address signals in a forward direction of the second sequence of address signals and in a reverse direction of the second sequence of address signals based on the second control pulses and only two other non-image data select signals.

20. The fluid ejection device of claim 19, wherein the means for providing a first sequence of address signals comprises:

means for initiating the first sequence of address signals via the control signal and one of the two non-image data select signals.

21. The fluid ejection device of claim 19, wherein the means for providing a first sequence of address signals comprises:

means for selecting the forward direction and the reverse direction of the first sequence of address signals via the control signal and one of the two non-image data select signals.

22. The fluid ejection device of claim 19, wherein:

the means for providing a first sequence of address signals comprises means for selecting the forward direction and the reverse direction of the first sequence of address signals via the control signal and one of the two non-image data select signals; and the means for providing a second sequence of address signals comprises means for selecting the forward direction and the reverse direction of the second sequence of address signals via the control signal and one of the two other non-image data select signals.

* * * * *